US006381428B1

(12) United States Patent
Yamamoto et al.

(10) Patent No.: US 6,381,428 B1
(45) Date of Patent: Apr. 30, 2002

(54) PHOTOCONDUCTOR UNIT AND IMAGE FORMING SYSTEM

(75) Inventors: Masashi Yamamoto; Toru Miyasaka, both of Hitachi; Masaru Nakano, Tsukuba; Akira Shimada, Hitachi; Kenji Mori, Tsuchiura; Akira Sasaki; Kazuhiro Wakamatsu, both of Hitachi, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/644,949

(22) Filed: Aug. 24, 2000

(30) Foreign Application Priority Data

Nov. 2, 1999 (JP) ..... 11-311940

(51) Int. Cl.[7] ..... G03C 15/00

(52) U.S. Cl. ..... 399/116; 347/115; 347/152; 399/110

(58) Field of Search ..... 399/110, 112, 399/116, 117, 299, 301, 302, 328, 94; 347/115, 116, 118, 138, 152

(56) References Cited

U.S. PATENT DOCUMENTS 5,787,324 A * 7/1998 Iwasaki ..... 399/112
6,021,287 A * 2/2000 Yanaka ..... 399/299 X
6,122,476 A * 9/2000 Bowler, Jr. ..... 399/328
6,157,797 A * 12/2000 Saito et al. ..... 399/107
6,198,891 B1 * 3/2001 Ishida et al. ..... 399/117

FOREIGN PATENT DOCUMENTS

| | | | |
|---|---|---|---|
| JP | 2-39063 | * | 2/1990 |
| JP | 8-54817 | * | 2/1996 |
| JP | 9-281769 | * | 10/1997 |
| JP | 10-48898 | * | 2/1998 |
| JP | 11-296009 | * | 10/1999 |

* cited by examiner

*Primary Examiner*—Joan Pendegrass
(74) *Attorney, Agent, or Firm*—Antonelli, Terry, Stout & Kraus, LLP

(57) ABSTRACT

In order to provide an image forming system characterized by compact configuration, high speed printing, high picture quality recording and excellent maintainability without image misregistration, an image forming system is provided, wherein multiple photoconductors are arranged along one of the surfaces of the intermediate transfer belt which is elongated in the longitudinal direction, and a fusing device is located on the other surface, with the photoconductors being integrated in one unit.

13 Claims, 22 Drawing Sheets

20
21
1a
1b
2
4a
4b
PHOTOCONDUCTOR DISPLACEMENT
PHOTOCONDUCTOR DISPLACEMENT (DISPLACEMENT ZERO)

PHOTOCONDUCTOR UNIT AND IMAGE FORMING SYSTEM

BACKGROUND OF THE INVENTION

The present invention relates to an image forming system including a copier, printer and fax machine to form color images based on electrophotographic technology.

Electrophotographic technology involves the formation of a static latent image corresponding to image data on a photoconductor, after which electrically charged toner particles are deposited on the photoconductor corresponding to the potential pattern of the static latent image, thereby visualizing the latent image as a toner image. Then, this toner image is transferred onto a recording medium, such as paper, to form an image on the paper. If a color image is to be formed in this process, toner of multiple colors, for example, yellow, magenta and cyan, must be superimposed to form the color image.

An image forming system to form color images is variously characterized by the method of superimposing toner particles of different colors. Proposed color image forming methods can be broadly classified into two types: a repeated development method where toner of various colors is developed repeatedly on one photoconductor to produce color images, and a simultaneous development method where toner particles of various colors are developed on multiple photoconductors simultaneously to produce color images. The following describes the details of various color image forming methods will be described.

In the repeated development method, one photoconductor is used to form a color image. This method includes the following three methods: photoconductor color superimposition transfer drum and intermediate transfer.

Of these methods, an intermediate transfer method capable of recording high quality pictures is disclosed in Japanese Patent Laid-Open No. 137179/1996, where multiple development devices which develop different color toner particles around the photoconductor and an intermediate transfer device are arranged so that the toner image formed on the photoconductor is transferred on the intermediate transfer device. This is repeated for each color, so that toner particles of multiple colors are superimposed on the intermediate transfer device. After that, the toner image on the intermediate transfer device is transferred onto paper, thereby producing a color image.

The simultaneous development method is disclosed in Japanese Patent Laid-Open No. 186894 /1998 and Japanese Patent Laid-Open No. 260593/1998, for example. This method uses multiple photoconductors, and toner images are formed simultaneously by each photoconductor. Toner images are transferred synchronously with paper feed, thereby forming color images. This color image forming method is also called the tandem method and is typical of the simultaneous development method.

SUMMARY OF THE INVENTION

Increasing use of colors and digital data in office environments has resulted in a growing demand for color images to be printed on recording media, such as paper. A color image forming system to meet this demand is required to satisfy the following four performance requirements: (1) compact configuration to allow installation at limited space installation site in an office, (2) high picture quality to produce photo outputs, (3) compatibility with a great variety of recording media such as the OHP and cardboards in addition to plain paper, and (4) high speed to ensure that a great volume of business documents can be printed in a limited time.

Of these, two requirements—(1) compact configuration which is a prerequisite for office installation and (2) high speed printing resulting from color image processing technology and high speed transmission technology supported by technologically advanced PCs and networks—are important performance requirements which are essential to the subsequent color image forming systems.

The tandem method introduced above facilitates this speed increase. This method forms toner images of various colors almost simultaneously. It allows color images to be formed at the same speed as that of the monochrome printer. However, images are created independently for each photoconductor, and this makes it very difficult to superimpose toner images of various colors. Registration of toner images of various colors depends on the layout accuracy of each photoconductor and the exposure device, such as pitch and parallelism. If they are not laid out with high accuracy, the picture quality will be subsequently deteriorated; for example, variations of hues, a double image or other troubles will result from misregistration of toner images of different colors Furthermore, this layout accuracy will be subsequently reduced when the user mounts or removes the consumable photoconductor at the time of replacement. When the tandem method is used, registration of toner images of different colors poses a serious problem if recording of high picture quality is to be ensured.

One object of the present invention is to provide a compact and high-speed image forming system which ensures recording of high picture quality.

Another object of the present invention is to provide a image forming system characterized by excellent maintainability.

An image forming system according to the present invention comprises multiple photoconductors, multiple exposure devices to form static latent images on each of said photoconductors, multiple development devices to form toner images on each of said photoconductors, an intermediate transfer device to form a color toner image by superimposing said toner images, a transfer device to transfer said color toner image to a recording medium, and a fusing device to fuse said color toner image on said recording medium; wherein said multiple photoconductors form one integral unit.

A photoconductor unit has multiple photoconductors arranged in a line, multiple charging devices to charge each of said photoconductors uniformly, and multiple photoconductor cleaners to clean each of said multiple photoconductors. Said multiple photoconductors, multiple charging devices and multiple photoconductor cleaners are configured in one unit.

Since multiple photoconductors are used for printing, higher printing speed is ensured than that obtained when only one photoconductor is used. Multiple photoconductors configured in one unit eliminate the possibility of displacement of photoconductors during mounting and dismounting at the time of replacement. Recording with a high picture quality is ensured without image misregistration during printing. Maintainability is also improved at the same time.

Furthermore, another image forming system according to the present invention comprises multiple photoconductors arranged in a longitudinal line, multiple development devices and multiple exposure devices arranged on one side of said multiple photoconductors, an intermediate transfer device arranged on the other side of said multiple photoconductors, and a form cassette arranged below said multiple photoconductors; wherein said multiple development devices and multiple exposure devices are arranged in the vertical direction relative to said multiple photoconductors, and said multiple development devices and multiple exposure devices are arranged alternately with respect to the direction of said multiple photoconductors.

Such a layout configuration allows for high speed printing despite use of multiple photoconductors. This permits a compact image forming system to be provided.

Fixing the exposure devices on the enclosure side of the image forming system eliminates the possibility of design-based misregistration of exposure. This makes it possible to provide an image forming system characterized by a stable exposure and high quality image recording.

DETAILED DESCRIPTION OF THE PREFERRED EMBODIMENTS

The following description of the present invention will be made with reference to the drawings.

First Embodiment

Figure 1:
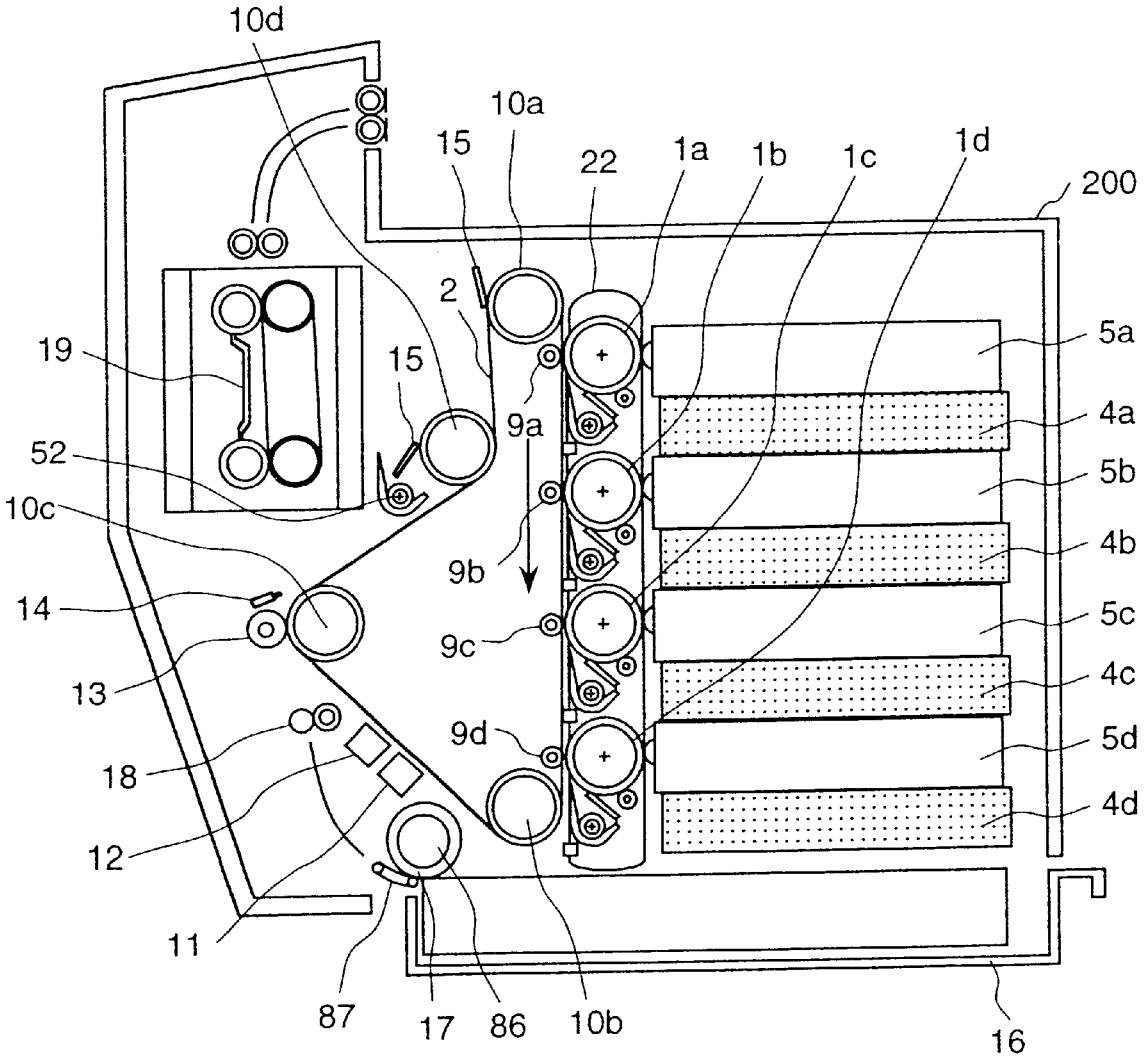
FIG. 1 is a cross-sectional diagram which represents one embodiment of the image forming system according to the present invention.

FIG. 1 represents a schematic cross section of the image forming system representing a first embodiment according to the present invention. It provides a compact image forming system characterized by high speed printing and high quality image recording.

Photoconductors 1*a*, 1*b*, 1*c*, and 1*d* corresponding to four colors of toner, including yellow, magenta, cyan and black, required for formation of a color image are arranged longitudinally at the center of an enclosure 200. They are connected rotatably about each axis by supports, and are provided as an integral photoconductor unit 22.

Furthermore, the intermediate transfer belt 2 is supported by four belt tension rollers 10*a*, 10*b*, 10*c* and 10*d* so as to contact the photoconductors 1*a*, 1*b*, 1*c*, and 1*d* arranged longitudinally, and it has an operative run which is longitudinally arranged with respect to the multiple photoconductors. In this case, auxiliary transfer rollers 9*a*, 9*b*, 9*c* and 9*d*, which operate to transfer the toner image from a respective photoconductor onto the intermediate transfer belt 2, are each provided at a position in face-to-face relation with a respective one of the photoconductors 1*a*, 1*b*, 1*c*, and 1*d*. Exposure devices 4*a*, 4*b*, 4*c* and 4*d*, which operate to expose the surfaces of photoconductors 1*a*, 1*b*, 1*c*, and 1*d* and to form static latent images thereon, and development devices 5*a*, 5*b*, 5*c* and 5*d*, which operates to make the static latent images visible, are arranged alternately in the longitudinal direction on the side of the photoconductors opposite to where the intermediate transfer belt 2 is arranged. As light clearance may be present between the exposure devices 4*a*, 4*b*, 4*c* and 4*d* and development devices 5*a*, 5*b*, 5*c* and 5*d*, or other components may be present. To make the equipment more compact, this space is preferably as small as possible.

Photoconductors 1*a*, 1*b*, 1*c*, and 1*d* rotate in the counterclockwise direction in FIG. 1. They rotate from upward to downward at the position in contact with the intermediate transfer belt 2. This rotation determines the arrangement for the other printing processes and the rotary direction of the intermediate transfer belt 2. In this case, intermediate transfer belt 2 rotates from upward to downward at the position in contact with each photoconductor.

An image sensor 11 to detect the misregistration of color images, an electric charge eliminator 14 for causing paper to separate from the intermediate transfer belt 2, and an intermediate transfer belt cleaner 15, which operates to clean toner from the intermediate transfer belt 2, are installed around the perimeter of the intermediate transfer belt 2. A belt discharged toner collector 52 is provided to collect the discharged toner cleaned by the intermediate transfer belt cleaner 15. Furthermore, a form cassette 16, paper feed mechanism 17, separation pad 87, resist roller 18 and fusing device 19 are arranged on the paper feed path.

Figure 3:
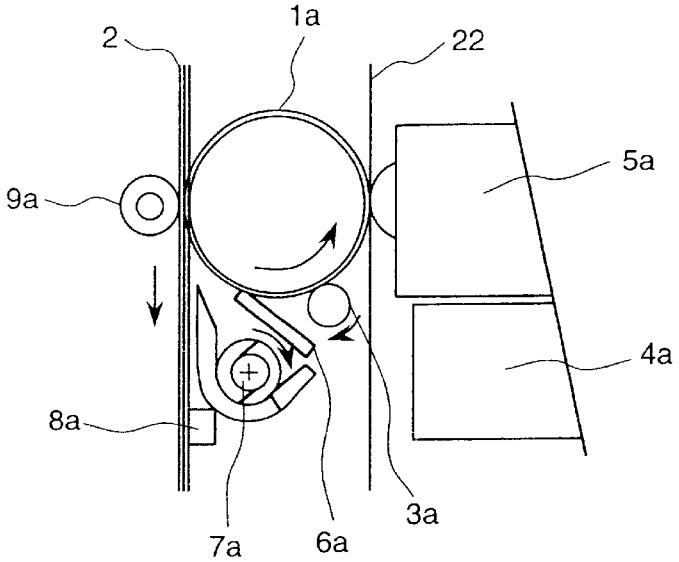
FIG. 3 is a diagram showing details of the elements disposed around the photoconductors of the image forming system according to the present invention.

FIG. 3 is an enlarged view showing the arrangement of elements around each photoconductor. The following description is directed to the photoconductor 1*a*, but is also applicable to the other photoconductors 1*b*, 1*c*, and 1*d*.

A charging device 3*a* to charge the photoconductor 1*a* electrically, an exposure device 4*a*, a development device 5*a*, the intermediate transfer belt 2, an erase lamp 8*a* to eliminate electric charge from the surface of photoconductor 1*a*, a photoconductor cleaner 6*a* to clean the remaining toner from the photoconductor surface, a discharged toner collector 7*a* to collect discharged toner cleaned by the photoconductor cleaner 6*a*, and an auxiliary transfer roller 9*a* to assist transfer of the toner image formed on the photoconductor 1*a* by development device 5*a* to the intermediate transfer belt 2 are provided around the photoconductor 1*a*.

This embodiment provides photoconductor cleaners 6*a*, 6*b*, 6*c* and 6*d* to remove the toner remaining on a respective photoconductor after the toner has been transferred onto the intermediate transfer belt 2, and the toner of the toner image deposited on the photoconductor from the intermediate transfer belt 2 due to reverse transfer. If toner remains on the photoconductor 1*a*, uneven exposure or mixing of colors of the toner of the development device Sa will occur. This makes it necessary to ensure perfect elimination of these toner particles. In the photoconductor cleaners 6*a*, 6*b*, 6*c* and 6*d*, cleaning blades may be used to clean the photoconductor. The cleaning blade rakes off the toner by using an elastic blade formed of rubber and the like brought directly in contact with the photoconductor, thereby ensuring perfect cleaning. Furthermore, the cleaning blade is designed to have a simple construction; it is comprised of only the blade. This construction permits the cleaner to be designed to have a compact configuration at a reduced cost.

The toner raked off by the photoconductor cleaners 6*a*, 6*b*, 6*c* and 6*d* is discharged by gravity into the discharged toner collectors 7*a*, 7*b*, 7*c* and 7*d* arranged below the photoconductors 1*a*, 1*b*, 1*c*, and 1*d*. The discharged toner collectors 7*a*, 7*b*, 7*c* and 7*d* transport the toner by means of rotating spiral rollers. Toner collected by discharged toner collectors 7*a*, 7*b*, 7*c* and 7*d* is finally transported into the discharged toner case through the discharged toner outlet path 102 arranged in the system, and is collectively discarded.

To stabilize the potential on the surfaces of photoconductors 1*a*, 1*b*, 1*c*, and 1*d*, it is effective to dampen the potential on the surface of the photoconductor before electrical charging. Reduction of the potential on the surface of the photoconductor weakens the electrostatic connection between the photoconductor and toner, and ensures a perfect cleaning of the toner remaining on the photoconductor. Furthermore, erase lamps 8*a*, 8*b*, 8*c* and 8*d* are provided to eliminate electric charge from photoconductors 1*a*, 1*b*, 1*c*, and 1*d*. The erase lamps 8*a*, 8*b*, 8*c* and 8*d* represent a LED array, which eliminates the electric charge from the photoconductor by light irradiation.

Figures 4A, 4B, 4C:
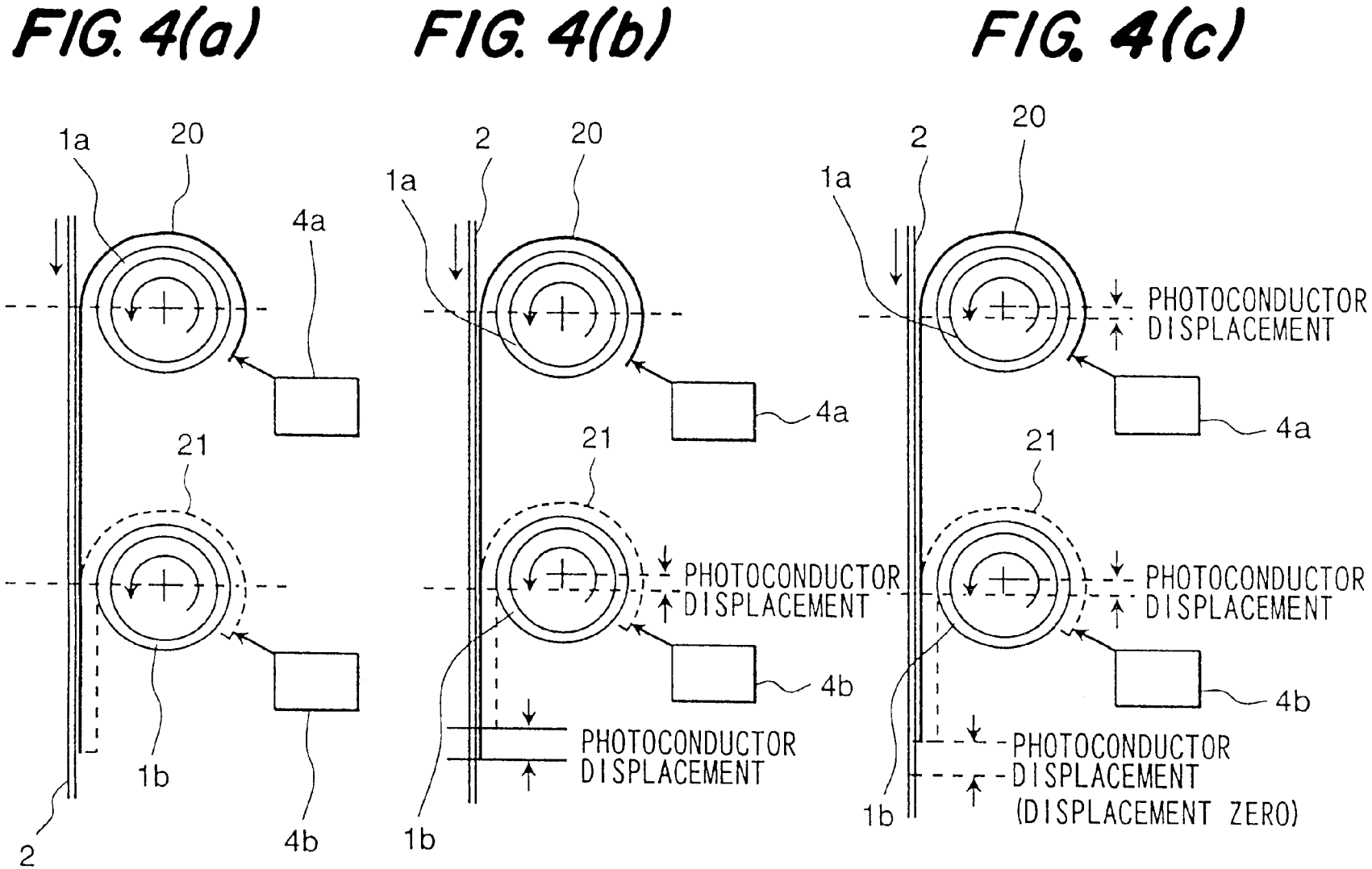
FIGS. 4(*a*) to 4(*c*) are diagram which illustrate misalignment of multiple photoconductors of the image forming system according to the present invention.

The following describes the positional relationship of photoconductors 1*a* and 1*b* and position of the image with reference to FIGS. 4(*a*) to 4(*c*). FIG. 4(*a*) shows the case in which photoconductors 1*a* and 1*b* are located at the proper positions. FIG. 4(*b*) shows the case where photoconductor 1*b* is misaligned. FIG. 4(*c*) indicates superimposition of images 20 and 21 formed by photoconductors 1*a* and 1*b*, respectively.

The image forming system according to the present invention is required to produce outputs of high resolution and high quality images, such as photos. To achieve high quality recording, it is necessary to ensure accurate printing of fine dots and improved uniformity of solid images. Variations of hues, a double image or other troubles will result from misregistration of toner images of different colors, and a substantial deterioration of high picture quality will occur. To prevent this, registration of the images of different colors must be done accurately.

The relative position of the photoconductors and exposure devices is important for accurate registration of the images of different colors.

Exposure is started by the exposure device 4*a* on the photoconductor 1*a* positioned on the upstream side in the rotating direction of intermediate transfer belt 2. The image 20 formed by the photoconductor 1*a* on the intermediate transfer belt 2 is superimposed on the image 21 formed by photoconductor 1*b*; therefore, image exposure on the second photoconductor 1*b* located immediately below the photoconductor 1*a* is delayed by the time required for the electrostatic latent image to be moved from the exposure position to the position of contact with intermediate transfer belt 2, and by the time requited for the surface of intermediate transfer belt 2 to pass through the space between the photoconductors 1*a* and 1*b*, from the time of starting image exposure on photoconductor 1*a* by exposure device 4*a*. Consequently, the distance from the exposure position on each photoconductor to the position of contact with intermediate transfer belt 2, the distance between the photoconductors 1*a* and 1*b* and the surface speed of each photoconductor and the intermediate transfer belt are important for registration of the images of different colors. In this case, if the photoconductor 1*b* is displaced from the specified position, as shown in FIG. 4(*b*), the tips of images 20 and 21 are also displaced, accordingly. Thus, the layout position of the photoconductor and exposure device is required to be very accurate.

However, surface wear and photosensitive characteristics of the photoconductor deteriorate during printing, with the result that the photoconductor may have to be replaced. In the image forming system used in a business environment, users themselves are required to replace the consumables. A configuration which is designed to allow easy replacement will conversely deteriorate layout accuracy of the photoconductor. High-accuracy layout of elements is currently very difficult.

When photoconductors are divided into separate units to be replaced individually, the layout accuracy of each photoconductor crucial to the registration of the images of different colors will be deteriorated because each photoconductor is a separate unit and is separately replaced.

According to the configuration used in the embodiment shown in FIG. 1, multiple photoconductors 1*a*, 1*b*, 1*c*, and 1*d* which operate to form the images of different colors are fixed and, when one or more photoconductors need to be replaced, laid out in a photoconductor unit 22, and the entire photoconductor unit 22 is replaced.

In the present embodiment, a photoconductor unit 22 is designed so that photoconductors 1*a*, 1*b*, 1*c*, and 1*d*, charging devices 3*a*, 3*b*, 3*c* and 3*d*, photoconductor cleaners 6*a*, 6*b*, 6*c* and 6*d*, and discharged toner collectors 7*a*, 7*b*, 7*c* and 7*d* are integrated into one unit. Erase lamps 8*a*, 8*b*, 8*c* and 8*d* may be laid out inside or outside the photoconductor unit 22.

If the photoconductor unit 22 itself is displaced from the specified position shown in FIG. 4(*a*), photoconductors will be laid out at displaced positions, as shown in FIG. 4(*c*). However, since the photoconductors are mounted as a unit, the displacements of the photoconductors 1*a* and 1*b* are equal to each other. This causes images 20 and 21 formed by the photoconductors 1*a* and 1*b* to be displaced from the normal position as they are transferred onto the intermediate transfer belt 2, but the displacements of images 20 and 21 are equal to each other, so that accurate superimposition of images is ensured in the final phase. In this case, displacement of the superimposed images of different colors at tip positions is sufficiently smaller than the accuracy of registration between the image tip and paper tip, when paper as a recording medium is fed and transferred, and this does not pose any problem in practice. As discussed above, photoconductors 1*a*, 1*b*, 1*c*, and 1*d* are fixed and laid out inside the photoconductor unit 22 so that the photoconductor unit 22 can be replaced. This configuration permits accurate registration of the images of different colors, and makes it possible to implement an image forming system characterized by high quality recording.

For toner registration of images of different colors, the layout accuracy of the exposure devices 4*a*, 4*b*, 4*c* and 4*d* to expose photoconductors 1*a*, 1*b*, 1*c*, and 1*d* is also important. For example, when the exposure devices to expose the photoconductors are installed on equipment which can be opened and closed, the layout position of each exposure device may be displaced, and image misregistration is likely to occur.

Thus, in the image forming system according to the present embodiment, exposure devices 4*a*, 4*b*, 4*c* and 4*d* are laid out so as to be fixed to the enclosure 200, thereby ensuring accurate layout positions of exposure devices 4*a*, 4*b*, 4*c* and 4*d*, without the possibility of their being displaced.

However, very accurate registration of the images of different colors is essential to increase the resolution to meet higher definition image recording requirements. The configuration according to the present embodiment may be insufficient.

To ensure accurate registration of the images of different colors in such cases, the present embodiment has a mechanism to allow a sample pattern to be printed, when consumables have been replaced or there is a big misregistration of images due to some failure, and to allow a user or operator to adjust the position where an image appears on the screen, based on the printed pattern, thereby ensure high quality recording at all times.

To ensure accurate registration of images of different colors furthermore, the above method is improved in that the position of each color image is detected, and the timing for writing by a position control mechanism can be provided in conformity to any misregistration of the image. This image misregistration control unit comprises an image sensor 11 to detect the position of each image (for example, four color images of yellow, magenta, cyan and black), and a misregistration calculation unit to determine the degree of misregistration of the actually printed image based on the detection result by the image sensor 11, and an image compensation unit to compensate for each image based on the output of the misregistration calculation unit. For image position, a pattern which permits easy detection of misregistration of images of different colors, for example, an image position detection pattern, is printed on the intermediate transfer belt 2. Then, the time when the image is detected or other related data is measured, thereby ensuring accurate measurement of the image position. This image position detection pattern is printed on a non-image area, such as between sheets of paper at a predetermined timing, for example, at the time of the system startup or during printing.

The following description relates to an embodiment of the image sensor 11. The image sensor 11 is laid out on the path of the intermediate transfer belt 2 to detect the position of images of different colors on the intermediate transfer belt 2. The image sensor 11 has a built-in light emitting unit and light receiving unit. The light issued from the light emitting unit is applied to the surface of the intermediate transfer belt 2, and its reflected light is received by the light receiving unit.

The intensity of reflected light is different, depending on whether or not there is toner on the intermediate transfer belt 2. So this difference is detected to determine the presence or absence of toner. In this case, to improve the toner image position detection accuracy, the spot diameter of the light emitted from the light emitting unit must be made smaller than the image misregistration tolerance. According to the present embodiment, misregistration of images of different colors is specified to not exceed 100 microns. So the spot diameter of the light emitted from the light emitting unit does not exceed 100 microns. A laser diode and LED can be used as the light emitting unit. As an image sensor, it is possible to use a potentiometer to measure the potential of the toner as an electrically charged particle, in addition to the above-mentioned light.

Figure 20:
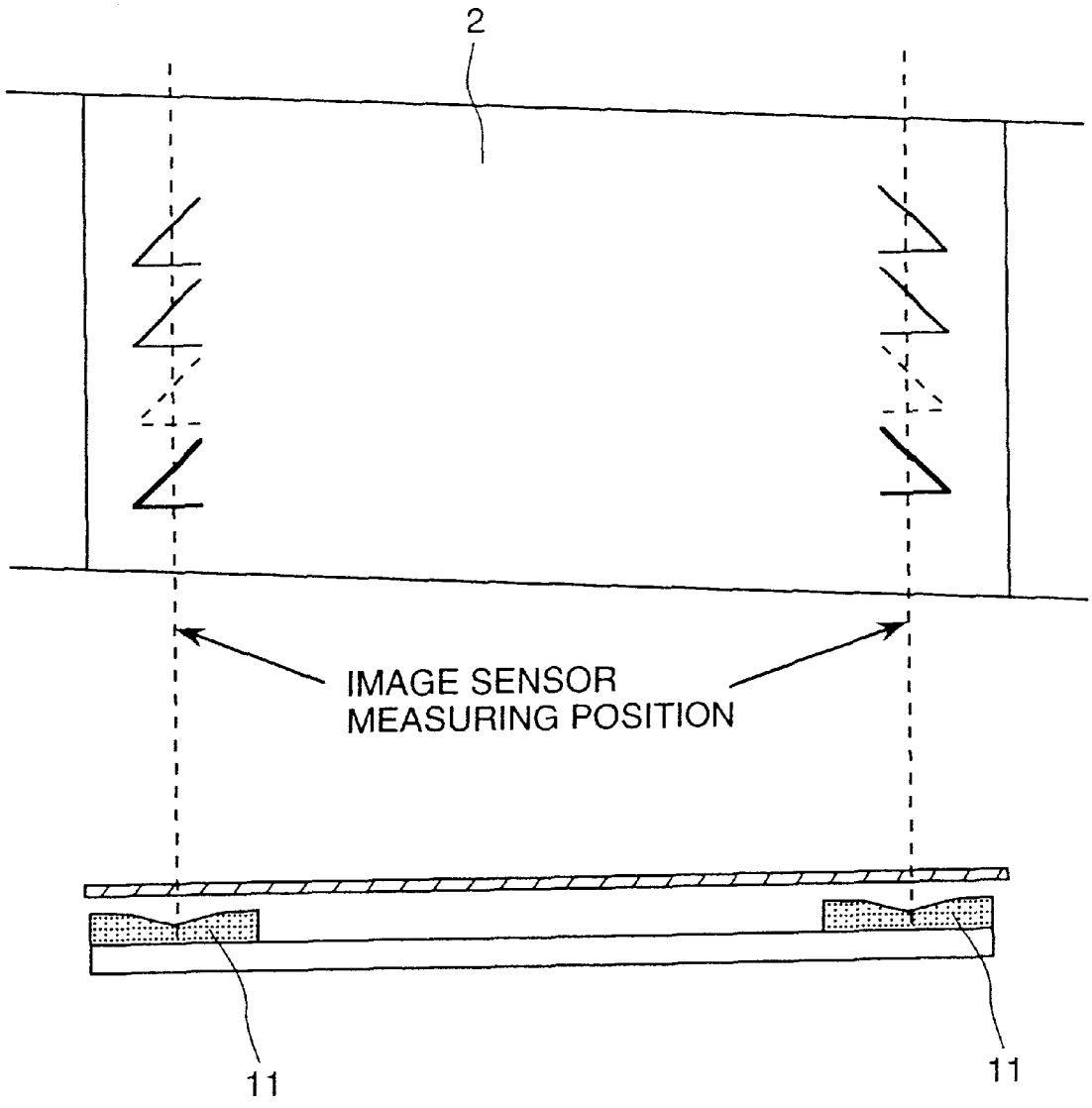
FIG. 20 is a diagram illustrating the image sensor and image misregistration of the image forming system according to the present invention.

Misregistration of toner images of different colors can be classified as (1) parallel misregistration of images of different colors in the vertical and lateral direction, (2) displacement of image angle, and (3) extension and contraction of images in the vertical and lateral direction. In the present embodiment, a total of two image sensors 11 to detect misregistration of images are laid out on the right and left of the intermediate transfer belt 2, as shown in FIG. 20. Measurement by multiple image sensors 11 ensures measurement of detailed image positions. If the detection by image sensor 11 shows that misregistration of images is greater than expected, misregistration is likely to have occurred to the exposure write timing and the position in each process. Based on this result, the misregistration calculation unit determines the manner and degree of image misregistration. From the result of measuring rear end position and right/left positions, as well as each image pattern tip position, the misregistration calculation unit determines the image positions and image extension or contraction. For example, measurement of each line of a wedge type character pattern reveals the tip position and angle deviation.

Based on this result, the image compensation unit adjusts the x and y coordinates for the write position of the image to be printed actually, and the image angle and length. When images of different colors are rotated, expanded and contracted by the image compensation unit, it is possible to use a method where all of the images to be printed are stored in the memory and image processing is carried out.

The image sensor 11 is laid out opposite to the surface where the toner of intermediate transfer belt 2 is deposited, so it may be contaminated by toner splashed from the intermediate transfer belt 2. This will cause the detection accuracy to be decreased. To avoid this, it is possible to provide a mechanism to clean the image sensor 11. To prevent the sensor from being contaminated, it is effective to put a cover over the light emitting unit and light receiving unit of the image sensor 11 when the image position is not being measured.

Furthermore, the level of the light detected by the light receiving unit of the sensor is changed in conformity to the volume of toner deposited, so it is possible to detect the volume of toner deposited on the intermediate transfer belt 2. When the picture quality is to be improved by providing a control mechanism to control the intensity of the exposure, the exposure time, and the development bias, etc. in conformity to the volume of toner deposited, as previously discussed, the image sensor 11 according to another embodiment can be used as a sensor to measure the volume of deposited toner.

Figures 2A, 2B, 2C, 2D:
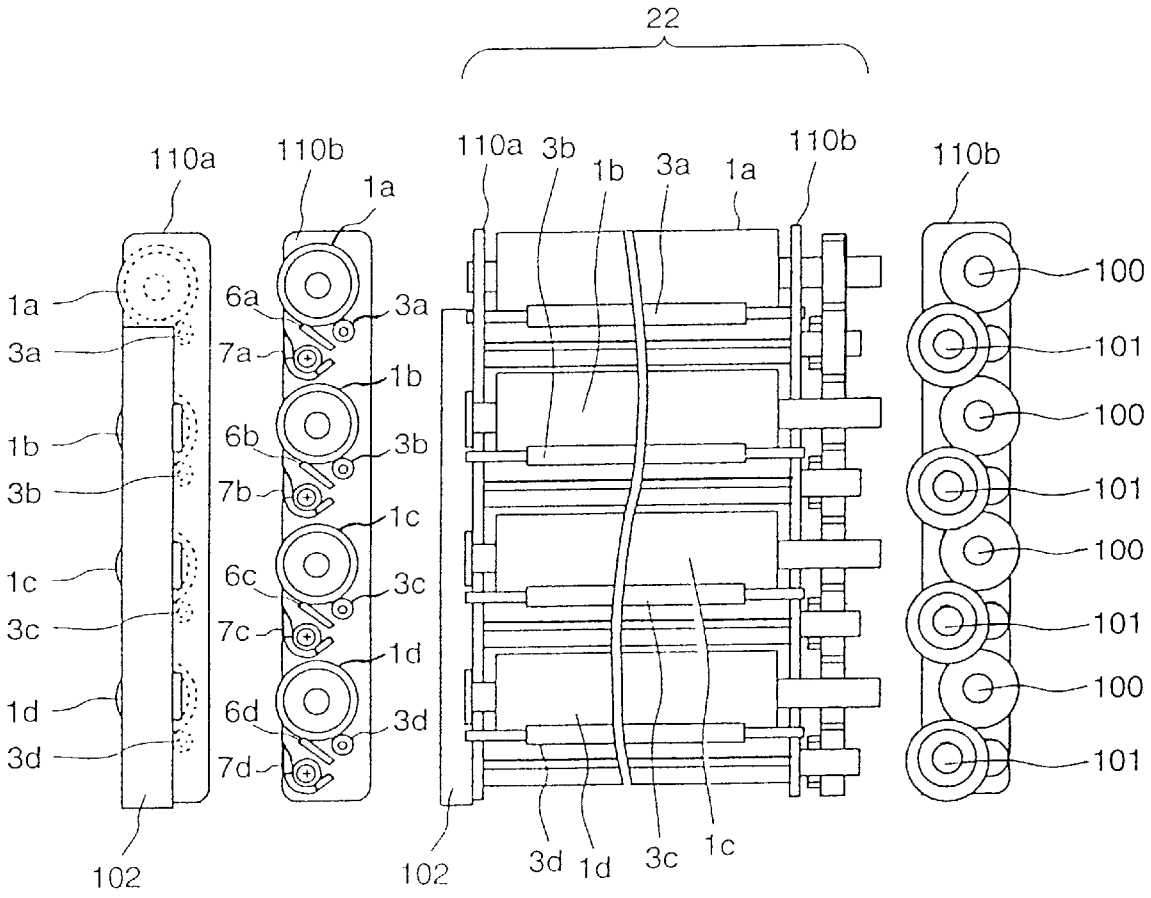
FIGS. 2(*a*) and 2(*b*) are side views, FIG. 2(*c*) is plan view and FIG. 2(*d*) is a side view showing the configuration of the photoconductor unit of the image forming system according to the present invention.

FIGS. 2(*a*) to 2(*d*) show details of an embodiment of the above-mentioned photoconductor unit 22. FIGS. 2(*a*) and 2(*b*) are side views of the photoconductor unit. FIG. 2(*c*) is a plan of the photoconductor unit, and FIG. 2(*d*) is a side views on the opposite side of FIG. 2(*a*).

As discussed above, the photoconductor unit 22 as seen in FIG. 2(*b*) comprises multiple photoconductors 1*a*, 1*b*, 1*c*, and 1*d*, photoconductor cleaners 6*a*, 6*b*, 6*c* and 6*d* to clean each of the photoconductors 1*a*, 1*b*, 1*c*, and 1*d*, discharged toner collectors 7*a*, 7*b*, 7*c*, and 7*d* to collect the discharged toner cleaned by each of the photoconductor cleaners 6*a*, 6*b*, 6*c* and 6*d*, and charging devices 3*a*, 3*b*, 3*c* and 3*d* to electrically charge the photoconductors 1*a*, 1*b*, 1*c*, and 1*d* uniformly.

The photoconductor unit 22 is laid out so that at least each of photoconductors 1*a*, 1*b*, 1*c*, and 1*d* is supported by two supports 110*a* and 110*b*, as shown in FIG. 2(*c*). Holders to hold these supports 110*a* and 110*b* are provided on the side of enclosure 200. Photoconductors 1*a*, 1*b*, 1*c*, and 1*d* are configured as one unit.

Accuracy adjustment at the time of manufacturing allows a layout to ensure that the space and parallelism among photoconductors 1*a*, 1*b*, 1*c*, and 1*d* are highly accurate.

Furthermore, when the user wants to replace the photoconductors, he can replace one photoconductor unit 22 integrating the photoconductors 1*a*, 1*b*, 1*c*, and 1*d*. This ensures a stable space and parallelism among photoconductors. In this configuration, photoconductors 1*a*, 1*b*, 1*c*, and 1*d* are replaced, mounted and dismounted as a photoconductor unit 22. The layout position of photoconductor unit 22 may be changed from the specified position, but the photoconductors 1*a*, 1*b*, 1*c*, and 1*d* inside the photoconductor unit 22 maintain a specified spacing and are parallel with one another. This eliminates the possibility of the photoconductor layout position being changed, and ensures easy image registration. The distance among photoconductors in the vertical and lateral directions remains unchanged and ensures easy replacement of photoconductors, thereby improving maintainability.

When such peripheral devices as the charging devices 3*a*, 3*b*, 3*c* and 3*d* related to the multiple photoconductors 1*a*, 1*b*, 1*c* and 1*d*, together with the multiple photoconductors, are integrated into one unit, a more stable, high quality and high definition image recording can be ensured without sacrificing maintainability.

The following describes how to drive the multiple photoconductors 1*a*, 1*b*, 1*c*, and 1*d* (FIGS. 2(*c*) and 2(*d*)).

The photoconductor can be driven either at the same speed for all photoconductors 1*a*, 1*b*, 1*c*, and 1*d*, or by using different speeds for them. If the variations of diameters of photoconductors 1*a*, 1*b*, 1*c*, and 1*d* can be reduced, all photoconductors are driven at the same speed.

Photoconductors 1*a*, 1*b*, 1*c*, and 1*d* are provided with a photoconductor drive gear 100 to rotate and drive shafts for connection with supports 110*a* and 110*b*. These photoconductors 1*a*, 1*b*, 1*c*, and 1*d* are driven by one gear from the side of the main unit (outside the photoconductor unit, on the side of enclosure 200). A discharged toner collector drive gear 101 is provided to drive the discharged toner collectors 7*a*, 7*b*, 7*c* and 7*d* at the same time. A discharged toner outlet path 102 to remove discharged toner is provided on the side opposite to the photoconductor drive gear 100, namely, on the side of the support 110*a*.

The connection gears to drive the photoconductors 1*a*, 1*b*, 1*c*, and 1*d* can be laid out on the side of the main unit to drive the photoconductors 1*a*, 1*b*, 1*c*, and 1*d* by four gears from the side of the main unit. In this case, assuming that photoconductor unit 22 is mounted and dismounted over the photoconductor drive gear 100 to drive the photoconductors 1*a*, 1*b*, 1*c*, and 1*d*, the gear of the main unit and photoconductor drive gear 100 are laid out at a slightly offset position so that they do not interfere when the photoconductor unit 22 is mounted and dismounted.

Photoconductors 1*a*, 1*b*, 1*c*, and 1*d* also can be connected by belts without using gears as in the above case.

If the photoconductors 1*a*, 1*b*, 1*c*, and 1*d* are driven at the same speed when there are big variations in the diameters of multiple photoconductors 1*a*, 1*b*, 1*c*, and 1*d*, differences in peripheral speeds will occur among photoconductors, and image is registration and slip will occur. These differences in peripheral speeds can be reduced by driving each of the photoconductors 1*a*, 1*b*, 1*c*, and 1*d* independently. Image registration accuracy can be improved by installing a motor to drive each of photoconductors 1*a*, 1*b*, 1*c*, and 1*d*; and, by compensating the differences in peripheral speeds of the photoconductors 1*a*, 1*b*, 1*c*, and 1*d* caused by variations in the diameters of the photoconductors 1*a*, 1*b*, 1*c*, and 1*d*, this will ensure high picture quality. In this case, to prevent deflection of the intermediate transfer belt 2 among photoconductors 1*a*, 1*b*, 1*c*, and 1*d*, the drive speed of the photoconductor 1*d* located downstream in the direction of the movement of intermediate transfer belt 2 can be made faster than that of the photoconductor 1*a* located upstream therefrom.

If the friction load of development devices 5*a*, 5*b*, 5*c* and 5*d* and photoconductor cleaners 6*a*, 6*b*, 6*c* and 6*d* can be reduced, photoconductors 1*a*, 1*b*, 1*c*, and 1*d* can be made to follow the intermediate transfer belt 2 without applying driving force to the photoconductors 1*a*, 1*b*, 1*c*, and 1*d*. In this case, the peripheral speed of each of the photoconductors 1*a*, 1*b*, 1*c*, and 1*d* can be matched to the speed of the intermediate transfer belt 2. This allows easy registration of toner particles of different colors. To ensure that the drive force of the intermediate transfer belt 2 is transmitted to the photoconductors 1*a*, 1*b*, 1*c*, and 1*d* in this case, a component to increase the friction coefficient may be placed on the surface of the intermediate transfer belt 2; for example, rubber or such high friction materials can be placed in the non-printing area of the intermediate transfer belt 2 or photoconductor 1.

To prevent deflection from occurring to the belt surface in response to the contact, as described above, with the intermediate transfer belt 2, photoconductors 1*a*, 1*b*, 1*c*, and id are located at the photoconductor pulling position, and drives the belt tension roller 10*b* laid out below the photoconductor 1*d* is driven. This belt tension roller 10*b* has a rubber or other frictional layer on the roller surface to prevent the belt and roller from slipping, and, as described above, belt deflection can be prevented by increasing the speed of the intermediate transfer belt 2 by a slight change of the peripheral speed of photoconductors 1*a*, 1*b*, 1*c*, and 1*d* and the speed of intermediate transfer belt 2. The intermediate transfer belt 2 can be driven in the following manner by applying tension to the belt. The deflection of intermediate transfer belt 2 on the surface where photoconductors are arranged can be reduced by giving tension to the belt at the component as a rotational load for the intermediate transfer belt 2, namely, at the surface of the intermediate transfer belt 2 on the photoconductor side where the transfer device 13 (FIG. 1) and intermediate transfer belt cleaner 15 are in contact with each other, in the present embodiment. The belt may be driven by the belt tension rollers 10*a*, 10*c* and 10*d* by giving tension to the intermediate transfer belt 2 using the belt tension rollers 10*a* and 10*b* or another component provided on the side of the photoconductor. For example, when tension is given to the belt by the belt tension roller 10*b* to drive belt tension roller 10*a*, the surface of the belt where photoconductors are laid out is always kept taut, so deflection does not occur.

Furthermore, if it is possible to reduce the contact load of intermediate transfer belt cleaner 15, the photoconductor can be made to follow the intermediate transfer belt 2. In this case, the photoconductors 1*a*, 1*b*, 1*c*, and 1*d* are made to follow the intermediate transfer belt 2, as described above, and their surface speeds become the same, thereby ensuring easy registration of the images of different colors.

When the speed of photoconductors 1*a*, 1*b*, 1*c*, and 1*d* and intermediate transfer belt 2 is to be made variable, they are driven by a motor, such as a pulse motor or servo motor, which permits speed control.

The following describes the driving method in other major processes.

In the present embodiment, the charging rollers shown in FIGS. 1 and 2 are used as charging devices 3*a*, 3*b*, 3*c* and 3*d*. To simplify the configuration around each photoconductor, the charging roller is driven by photoconductors 1*a*, 1*b*, 1*c*, and 1*d*. However, drive power can be supplied from the photoconductor and another drive mechanism if a sufficient friction with the photoconductor cannot be obtained because the charging roller having a larger diameter is used to prolong service life, or a highly lubricated surface layer on the surface of the charging roller is formed to prevent toner from depositing them.

Figure 5:
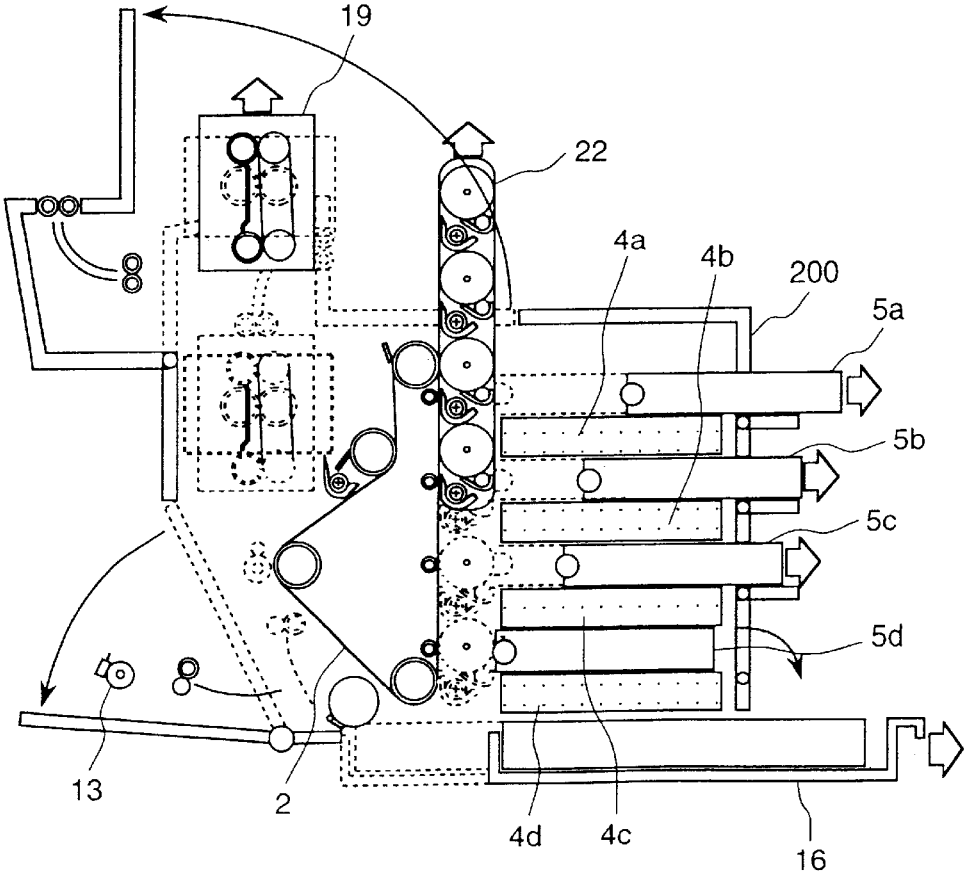
FIG. 5 is a sectional diagram which shows how to mount and dismount each stage of the image forming system according to the present invention.

As shown in FIG. 5, each of the development devices 5*a*, 5*b*, 5*c* and 5*d* is designed as a unit capable of being mounted and dismounted independently. Power is separately transmitted to each of the development devices 5*a*, 5*b*, 5*c* and 5*d*. In the present embodiment, development device drive motor power is branched off into four parts on the main unit side to drive each development device. Each development device can also be driven by each photoconductor.

Figure 11:
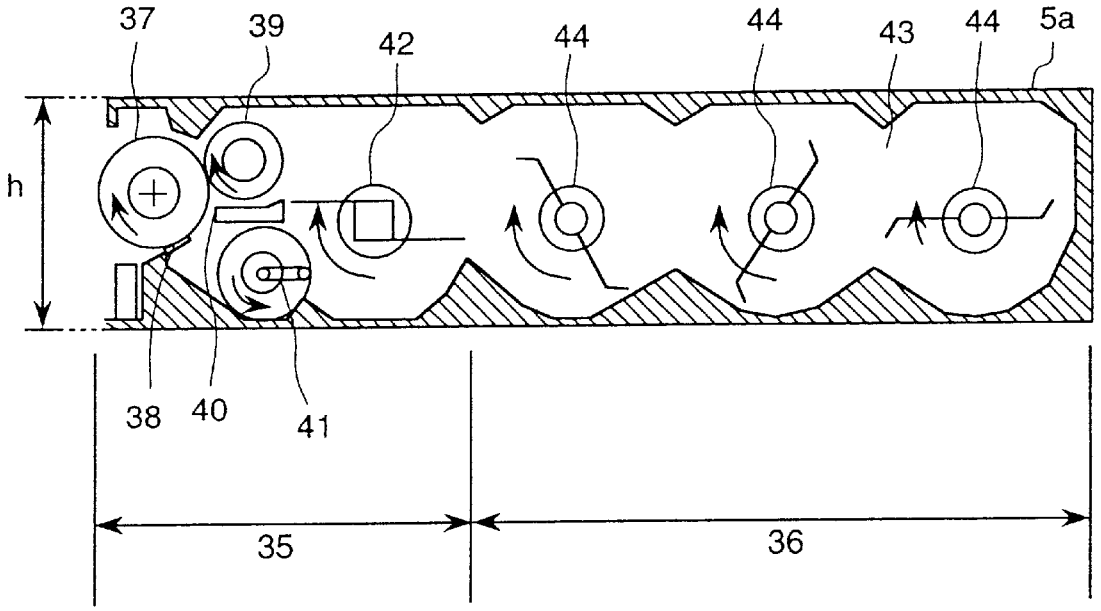
FIG. 11 is a diagram of an embodiment of the development device of the image forming system according to the present invention.

In the image forming system based on a non-magnetic one-component development method, as shown in FIG. 11, the volume of toner deposited can be adjusted by changing the speed of the development roller 37. So, in order to adjust the deposited toner volumes of different colors, it is possible to individually vary the speeds of development devices 5*a*, 5*b*, 5*c* and 5*d* for different colors by driving each of the development devices 5*a*, 5*b*, 5*c* and 5*d* by a separate motor.

In the embodiment shown in FIG. 1, a transfer roller is used as a transfer device 13. To simply the mechanism, this transfer roller is made to follow the intermediate transfer belt 2, but it can also be driven when the transfer roller apples a big rotational load to the intermediate transfer belt 2.

The following describes the image forming system according to an example of the printing sequence, with reference to FIGS. 1 and 3.

When the print command is sent to the controller (not illustrated), the drive of intermediate transfer belt 2, and the drive and electrostatic charging of the photoconductor 1*a*, 1*b*, 1*c*, and 1*d* are started. Then, the photoconductor 1*a* in contact with the intermediate transfer belt 2 is subjected to image exposure by the exposure device 4*a*, and an electrostatic latent image is formed on the photoconductor 1*a*. Then, the electrostatic latent image is developed by the development device 5*a*, and a toner image is formed on the photoconductor 1*a*. At the same time, a toner image is transferred on the intermediate transfer belt 2. Almost at the same time, image exposure is performed on the photoconductor 1*b* located immediately below, and a toner image is formed by the development device 5*b*. The start of exposure of this photoconductor 1*b* is timed to ensure that the toner image formed on the photoconductor 1*b* can be accurately superimposed on the image previously formed by the photoconductor 1*a* on the intermediate transfer belt 2. In this process, an image with two color toner images superimposed is formed on the intermediate transfer belt 2. Similarly, exposure, development and transfer are carried out on the 3rd and 4th color photoconductors 1*c* and 1*d*, and a full color image is formed after toner images of different colors are super imposed on the intermediate transfer belt 2. The full color image on the intermediate transfer belt 2 is transferred onto the paper or other recording medium which has been fed from the form cassette 16 by the transfer device 13, and is fused by the fusing device 19. Paper is then discharged from above the enclosure 200. To record a high picture quality full color image in the present embodiment, four-color toner is used to obtain full color image recording. Full color image recording can also be obtained by use of toner of three colors; yellow, magenta and cyan. In this case, there will be three printing processes using the photoconductor and development device.

The color image forming system based on electrophotographic technology forms a color image by superimposing toner of different colors. The image forming system according to the present embodiment is based on a simultaneous printing method where four photoconductors corresponding to the toner colors of yellow, magenta, cyan and black are used, and images are formed almost at the same time.

The following further describes the layout relationship of the image forming system including the photoconductors and intermediate transfer devices according to the present embodiment as shown in FIG. 1. The description refers particularly to the belt-formed intermediate transfer device.

In the image forming system according to the present embodiment, the toner images of different colors formed on the photoconductors 1*a*, 1*b*, 1*c*, and 1*d* have been superimposed on the intermediate transfer device. Then, these images are transferred to the final recording medium, such as paper, collectively. This does not require the photoconductor unit 22 and fusing device 19 to be arranged on the same line. In the image forming system shown in FIG. 1, an intermediate transfer belt 2 is arranged between the photoconductor unit 22 and the fusing device 19. This saves space, because it improves the layout configuration in that the system is laid out in a slender form in the direction where photoconductors are laid out.

The entire system can be made compact by stretching the intermediate transfer belt 2 so that the cross section of the entire belt is reduced. Furthermore, the exposure devices 4*a*, 4*b*, 4*c* and 4*d* and development devices 5*a*, 5*b*, 5*c* and 5*d* which respectively expose and develop the photoconductor 1 are stacked and laid out in the longitudinal direction. An increase in the size of these components causes the system dimensions, especially the height, to be increased. In the present embodiment, the dimension of the exposure devices 4*a*, 4*b*, 4*c* and 4*d* and development devices 5*a*, 5*b*, 5*c* and 5*d* in the direction of height is made smaller than that in the horizontal direction, thereby making the entire system compact in size.

In the present embodiment, photoconductors 1*a*, 1*b*, 1*c*, and 1*d* are laid out almost in a line in the longitudinal direction. The intermediate transfer belt 2 is laid out generally in line with the direction in which photoconductors 1*a*, 1*b*, 1*c*, and 1*d* are laid out. The surface of the intermediate transfer belt 2 on the side of the photoconductors is flattened to ensure safety of belt traveling, which is crucial when superimposing toner images formed by the photoconductors 1*a*, 1*b*, 1*c*, and 1*d*. At the same time, the process parts disposed around the photoconductors 1*a*, 1*b*, 1*c*, and 1*d* are made to have the same size for parts standardization, thereby ensuring lower parts cost and easy adjustment of printing conditions.

As described above, photoconductor unit 22, which is equipped with the photoconductors 1*a*, 1*b*, 1*c*, and 1*d* is laid out in the longitudinal direction in the present embodiment. The photoconductor unit 22, intermediate transfer belt 2 and fusing device 19 are relatively arranged in the lateral direction (perpendicular to the direction of gravity). Adoption of the above-mentioned layout configuration allows transfer device 13 and fusing device 19 to be laid out close to the outer surface of the system. It also allows the paper feed path to be arranged along the outer surface of the main unit. Consequently, even when paper jamming has occurred and paper remains inside the main unit, paper can be easily removed by opening the back of the enclosure 200 (on the side where the transfer device is installed). For example, when paper jamming has occurred during the feed of the recording medium between the photoconductors and transfer belt, each photoconductor and transfer belt must be removed in order to remove the recording medium remaining in the system. This will involve very complicated procedures.

Reference will be made to FIG. 5 to describe one embodiment of the method for replacing the process parts, including the photoconductor unit 22 and development devices 5*a*, 5*b*, 5*c* and 5*d* of the image forming system according to the present embodiment, and the mechanism for opening various parts of the enclosure.

As described above, surface wear and deterioration occur to photoconductors as printing is repeated, with the result that photoconductors must be replaced. The development devices must also be replaced as the toner is consumed. To ensure maintainability, easy replacement of consumables including these photoconductors and development devices is very important.

In the present embodiment, the photoconductor unit 22 integrating the photoconductors 1*a*, 1*b*, 1*c*, and 1*d* is designed to be mounted and dismounted in the direction where photoconductors 1*a*, 1*b*, 1*c*, and 1*d* are laid out, namely, in the longitudinal direction. In the embodiment shown in FIG. 1, the photo conductor unit 22, which is elongated in the longitudinal direction, is arranged between the exposure devices 4*a*, 4*b*, 4*c* and 4*d* fixed to the enclosure of the main unit and the intermediate transfer belt 2. Adoption of the above configuration ensures easy replacement.

In the image forming system according to the present embodiment, furthermore, development devices 5*a*, 5*b*, 5*c*, 5*d* for different colors are laid out along the photoconductor unit 22 vertically with respect to the direction where the photoconductor unit 22 is laid out (a little obliquely in the longitudinal or lateral direction). It is designed to be mounted and, dismounted by sliding them in the lateral direction, namely, vertically with respect to the direction where photoconductor unit 22 is laid out. In the present embodiment, development devices 5*a*, 5*b*, 5*c* and 5*d* are laid out alternately among exposure devices 4*a*, 4*b*, 4*c* and 4*d* fixed to the enclosure 200 of the main unit. This configuration ensures easy replacement and reduces the operator's burden when replacing the consumables.

Furthermore, charging devices 3*a*, 3*b*, 3*c* and 3*d*, and photoconductor cleaners 6*a*, 6*b*, 6*c* and 6*d* are replaceable since they are contaminated due to deposition of toner in the printing process. In the image forming system according to the present embodiment, photoconductor cleaners 6*a*, 6*b*, 6*c* and 6*d* are laid out inside the photoconductor unit 22, as shown in FIG. 2, and can be replaced simultaneously with photoconductor unit 22. In this case, charging devices 3*a*, 3*b*, 3*c* and 3*d* and photoconductor cleaners 6*a*, 6*b*, 6*c* and 6*d* themselves may be configured as a unit to facilitate mounting and dismounting from the photoconductor unit 22.

The photoconductors 1*a*, 1*b*, 1*c*, and 1*d* are laid out and fixed inside the photoconductor unit 22, so all photoconductors are replaced when the photoconductor unit 22 is replaced. However, when printing is performed by using the mechanism which connects and disconnects photoconductors 1*a*, 1*b*, 1*c*, and 1*d* and intermediate transfer belt 2 as described above, and by using only the photoconductor of the toner required for printing, the degree of wear and deterioration will be different for each photoconductor. In the configuration which allows simultaneous replacement of all photoconductors, replacement of the photoconductor unit 22 will be determined by the photoconductor which has been most frequently used. This will mean a waste of other photoconductors which have been used less frequently. In this case, it is possible to allow each photoconductor to be mounted and dismounted from the photoconductor unit 22, so that each photoconductor can be replaced in conformity to the number of sheets processed thereby.

To ensure accurate registration of toner images of different colors, exposure devices 4*a*, 4*b*, 4*c* and 4*d* are directly fixed to the enclosure 200. Another configuration which is applicable to the image forming system according to the present embodiment is one in which each exposure device is fixed by an exposure fixing component, and an exposure unit containing four exposure devices 4*a*, 4*b*, 4*c* and 4*d* is fixed to the enclosure 200 of the main unit. Exposure devices 4*a*, 4*b*, 4*c* and 4*d* are not replaced as consumables, but easy system adjustment can be ensured by adopting the configuration which allows mounting and dismounting of the devices from the main unit.

The erase lamps 8*a*, 8*b*, 8*c* and 8*d* can be fixed to the enclosure of the main unit or can be arranged inside photoconductor unit 22.

In the present embodiment, the service life of intermediate transfer belt 2 is the same as that of the main unit.

The belt tension rollers 10*a*, 10*b*, 10*c* and 10*d* are fixed to the enclosure 200. However, they may be scratched or damaged due to user operation error and other causes, and may have to be replaced. Therefore, the intermediate transfer belt 2 can be designed as a unit to permit replacement.

The intermediate transfer belt cleaner 15 is not replaced in the image forming system according to the present embodiment, and is fixed to the enclosure of the main unit. It goes without saying that the intermediate transfer belt cleaner 15 can be designed as a unit to allow replacement, as described above; or, for example, the intermediate transfer belt unit cleaner 15 can be laid out in the intermediate transfer belt unit to permit simultaneous replacement with the intermediate transfer belt 2.

The transfer device 13 is contaminated by toner and paper powder. If the transfer performance is greatly affected by this contamination, it is possible to design the transfer device 13 so that it can be replaced.

The fusing device 19 has a high temperature, and a great variety of types of recording media are passed through it. This makes it difficult to maintain a high fusing performance. So, in the image forming system according to the present embodiment, the fusing device 19 is designed as a unit which can be replaced. It goes without saying that, when the oil application mechanism (FIG. 16) to apply silicone and other oil is used to improve the fusing performance, or a cleaning mechanism 84 to clean the fusing roller surface is provided, each of them can be laid out as a separate unit on the fusing device 19 to permit replacement.

Highly accurate registration of the toner image formed on the multiple photoconductors 1*a*, 1*b*, 1*c*, and 1*d* is essential. The image forming system shown in FIG. 1 is designed in such a way that the side plates are used to hold the process parts in-between from both ends in the axial direction. This configuration ensures that layout positions for the photoconductor unit 22, exposure devices 4*a*, 4*b*, 4*c* and 4*d*, and a belt tensioning roller to stretch the intermediate transfer belt 2 can be determined accurately by the side plates.

Consequently, the process can be mounted and dismounted in the vertical or lateral direction, as seen in FIG. 5, when each process part is to be replaced.

A top cover which can be opened and closed is provided on the top of enclosure 200. Photoconductor unit 22 and fusing device 19 are replaced by releasing this cover and pulling these elements out upward in the longitudinal direction. Furthermore, a cover which can be opened and closed to replace the development devices 5*a*, 5*b*, 5*c* and 5*d* is provided on the right side of the main unit shown in FIG. 6. Since development devices 5*a*, 5*b*, 5*c* and 5*d* are required to be positioned to bring the development roll in contact with the photoconductor, a load must be applied to the side of the photoconductors 1*a*, 1*b*, 1*c*, and 1*d*. In the image forming system according to the present embodiment, the development device is pressed against the cover to be opened to replace the development devices 5*a*, 5*b*, 5*c* and 5*d*, and the component is mounted. when the door is closed, the development device is pushed inside with an appropriate load.

Figure 6:
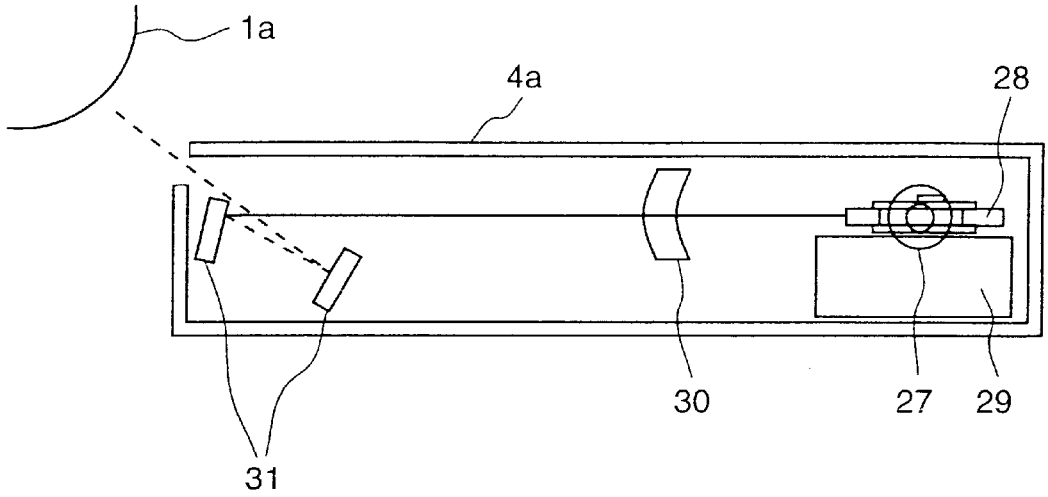
FIG. 6 is a diagram showing an embodiment of the exposure device of the image forming system according to the present invention.

A door to remove the recording medium is installed on the left side of the main unit shown in FIG. 6. According to the present embodiment, the paper feed path is laid out generally in the vertical direction so that it does not make an abrupt turn along the outer surface of the main unit. This prevents the recording medium from being bent. This method is applicable to a great variety of paper including cardboards. At the same time, it ensures easy removal of the recording medium.

The form cassette 16 to supply paper is designed to be inserted or removed from the right side of the main unit.

According to the present embodiment, as shown in FIG. 5, each process part is held in-between by the side plates. For example, it is possible that an opening is provided on the side plate with respect to the direction where the recording medium is discharged, and each process unit is replaced through that opening. In this case, photoconductor unit 22 and development devices 5*a*, 5*b*, 5*c* and 5*d* are each mounted or dismounted in the axial direction of the rotary shaft.

The following describes the detailed configuration of each process:

In the image forming system shown in FIG. 1, in order to ensure that the printing speed in the color print mode is the same as that of a monochrome printer, the process speed—the traveling speed of the photoconductor, intermediate transfer belt and recording medium—is set at 100 mm/s (100 mm/sec.), as discussed above. If the process speed is set to 100 mm/s, the printing speed of about 16 PPM and 24 PPM is obtained when A4 paper is fed in the longitudinal or lateral direction, even if consideration is given to the space between sheets of paper. This makes it possible to obtain a speed equivalent to that of the current monochrome printer.

Each of photoconductors 1*a*, 1*b*, 1*c*, and 1*d* used in the image forming system shown in FIG. 1 is a drum-formed photoconductor having the same diameter. It has an organic photosensitive layer provided on the surface of the aluminum cylindrical tube. It goes without saying that an inorganic photoconductor, such as an amorphous silicone photoconductor, can be used as the photoconductors. Use of a drum-formed rigid body as the photoconductors 1*a*, 1*b*, 1*c*, and 1*d* makes it possible to stabilize the photoconductor surface speed, which is important for registration of the toner images formed on the photoconductors of different colors. Furthermore, use of the drum of the same diameter reduces the parts cost.

The following describes the diameter of the photoconductors 1*a*, 1*b*, 1*c*, and 1*d*. The entire system can be designed in a more compact configuration when the diameter of the photoconductor is smaller. However, the potential on the surface of the photoconductor requires a long response time from irradiation of light to damping. The response time varies according to the sensitivity of the photoconductor. The response time of the organic photoconductor offered at lower costs at present is about 0.1 to 0.2 sec. So, the distance between the exposure point on the photoconductor where the light of the exposure device is applied and the development point where the development device develops the photoconductor must be about 10 mm to 20 mm, since the process speed is 100 mm/s in the image forming system shown in FIG. 1. With consideration given to this response speed and the layout of the process parts, such as the charging device and the photoconductor cleaners around the photoconductor, the photoconductor diameter has been studied. This study has revealed that 40 mm or more is necessary. If the photoconductor is 40 mm or less, the distance between exposure and development points cannot be ensured, and the response of the photoconductor is insufficient. Based on this study, the photoconductor diameter is set at 40 mm in the present embodiment. It goes without saying that, when there is an improvement in the photoconductor sensitivity, photoconductors of smaller diameter, for example, a diameter of about 30 mm, may be used. When higher speed printing is important, the photoconductor diameter must be increased.

Furthermore, belt-formed photoconductors can be used. Use of belt-formed photoconductors involves two problems; the belt offset must be avoided, and the structure is more complicated than that of the drum formed photoconductors. However, the belt tensioning method allows the photoconductor layout space to be reduced, and provides an increased allowance for the layout of the units which carry out processes around the photoconductor. This allows a more compact configuration in the space around the photoconductor Charging devices 3*a*, 3*b*, 3*c* and 3*d* used in the present embodiment charge the photoconductor 1 by utilizing the charging roller to which a bias voltage applied. The charging roller has a charging roller elastic layer formed on the charging roller metallic shaft, and has a charging roller surface layer formed thereon. To charge the photoconductor uniformly using the charging roller, it is essential to ensure contact between the charging roller and the photoconductor. For this purpose, the charging roller is designed such that the charging roller metallic shaft surface with the charging roller elastic layer formed of rubber materials, such as solid rubber and sponge rubber. At the same time, it provides contact with the photoconductor with adequate loads in order to ensure formation of a stable nip. Furthermore, the rubber material of the charging roller elastic layer is made conductive or semi-conductive. As a result, a bias voltage applied to the charging roller metallic shaft is effectively applied to the photoconductor, thereby improving the charging reliability. A charging roller surface layer of fluorine resin or the like is provided on the surface in order to prevent the plasticizer contained in the rubber material of the charging roller elastic layer from degenerating the toner and photoconductor, to ensure longer service life of the charging roller 23 and to improve the toner releasing property.

The charging roller of the charging devices 3*a*, 3*b*, 3*c* and 3*d* of the image forming system shown in FIG. 1 has a charging roller elastic layer of urethane sponge rubber having a thickness of 2 mm provided on the charging roller metallic shaft having a diameter of 5 mm, and a charging roller surface layer in the form of a fluorine resin tube is provided on the surface. Therefore, the diameter of the charging roller is as small as about 9 mm, but a sponge rubber is used for the charging roller elastic layer 25. This ensures an excellent contact with the photoconductors. Use of such a small-diameter charging roller permits an allowance to be given to process layout around the photoconductor.

The resistance of these charging roller elastic layers and the surface layer is as low as about 10 kilohms cm. This allows photoconductors to be charged at a low voltage. Furthermore, the image forming system according to the present embodiment a lows use of a corona charging device in addition to the charging device 3.

The corona charging device has a corona wire laid out inside the shield case provided at the opening. A high pressure is applied to the wire to generate corona discharge. An electrical charge discharged from the opening is irradiated on the photoconductor to charge the photoconductor 1. In order to stabilize the charged potential of the photoconductor, the opening can be equipped with a grid to which a specified voltage is applied. In the corona charging device, a spark discharge will occur and the discharge will become unstable if the distance between the wire and shield case is small. Namely, the distance between the wire and shield case cannot be made small. So the size of the entire charging device tends to be greater than that of the charging roller, as discussed above. However, the corona charging device allows charging without direct contact with the photoconductor. This makes it possible to prolong the service life of the charging device. If a longer service life is more important, the corona charging device can be used.

FIG. 6 shows an embodiment of the exposure device 4*a* of the image forming system according to the present embodiment. The same configuration also applies to the other exposure devices 4*b*, 4*c* and 4*d*.

In offices, recent progress in the development of computers has made it possible to handle a photographic image as well as text. To catch up with this trend, the image forming system shown in FIG. 1 has a printing density (resolution) of 600 dpi (dots/inch). In the image forming system based on electrophotographic technology, high quality recording of a photographic image requires at least 300 dpi. The image forming system according to the present embodiment has a printing density of 600 dpi, which meets the requirements sufficiently.

The present embodiment uses a laser exposure device comprising semiconductor laser 27, polygon mirror 28, polygon motor 29 and Fθ lens 30.

The laser exposure device shown in FIG. 6 uses the laser beams of the semiconductor laser 27 and operates to reflect and scan the beams using the polygon mirror 28. The Fθ lens 30 is used to correct the differences of focal distances resulting from the differences of the optical paths leading to the photoconductors to be exposed, and the fluctuations of the traveling distance on the scanned surface per unit rotary angle of polygon mirror 28. To ensure a laser scanning width corresponding to the recorded image width, a long optical path must be provided in the space from the polygon mirror 28 to the photoconductor. If the scanning angle of the polygon mirror 28 is reduced, a stable volume of exposure can be gained in the scanning direction since the volume of correction by the Fθ lens 30 is small. At the same time, the number of polygon mirrors 28 can be increased, thereby allowing high speed printing. However, a small scanning angle requires the distance from the polygon mirror 28 to the photoconductor to be increased. This results in an increased size of the entire laser exposure device. To ensure a printing speed on the level of a monochrome printer speed, the present embodiment uses a hexahedral polygon mirror which is generally used in a monochrome printer.

To ensure stable rotation, the polygon motor 29 which operates to rotate the polygon mirror 28 is preferably laid out to ensure that the polygon mirror 28 is rotated horizontally relative to the direction of gravity. In this case, the height of the exposure device cannot be made smaller than that of the polygon motor 29 which rotates the polygon mirror 28, plus the space of the Fθ lens 30 located above the laser scanning surface. In the image forming system shown in FIG. 1, the process speed is 100 mm/s. To achieve a printing density of 600 dpi, the hexahedral polygon mirror 28 must be driven at a rate of about 24,000 rotations per second. Currently, the height required by the polygon motor 29 rotating at this speed is about 20 mm. The height of the Fit lens 30 must be about 10 mm in order to ensure production stability. Therefore, the maximum possible height for the current laser exposure device is about 30 mm. The laser exposure device according to the present embodiment provides a horizontal rotation of the polygon mirror 28. To minimize the height of the entire laser exposure device, the laser beam that is reflected by polygon mirror 28 and has passed through the Fθ lens 3 is reflected by the folding mirror 31, after it has passed through the Fθ lens 30, as shown in FIG. 6, and this beam exposes the photoconductor 1*a* along a path in an upward slanting direction.

Furthermore, in the configuration shown in FIG. 6, the upper and lower portions of the exposure device are flat so as to ensure easy replacement of the development device disposed between exposure devices.

The exposure device shown in FIG. 6 is designed so as to minimize its height, so that the exposure device can be about 30 mm high.

Figure 7:
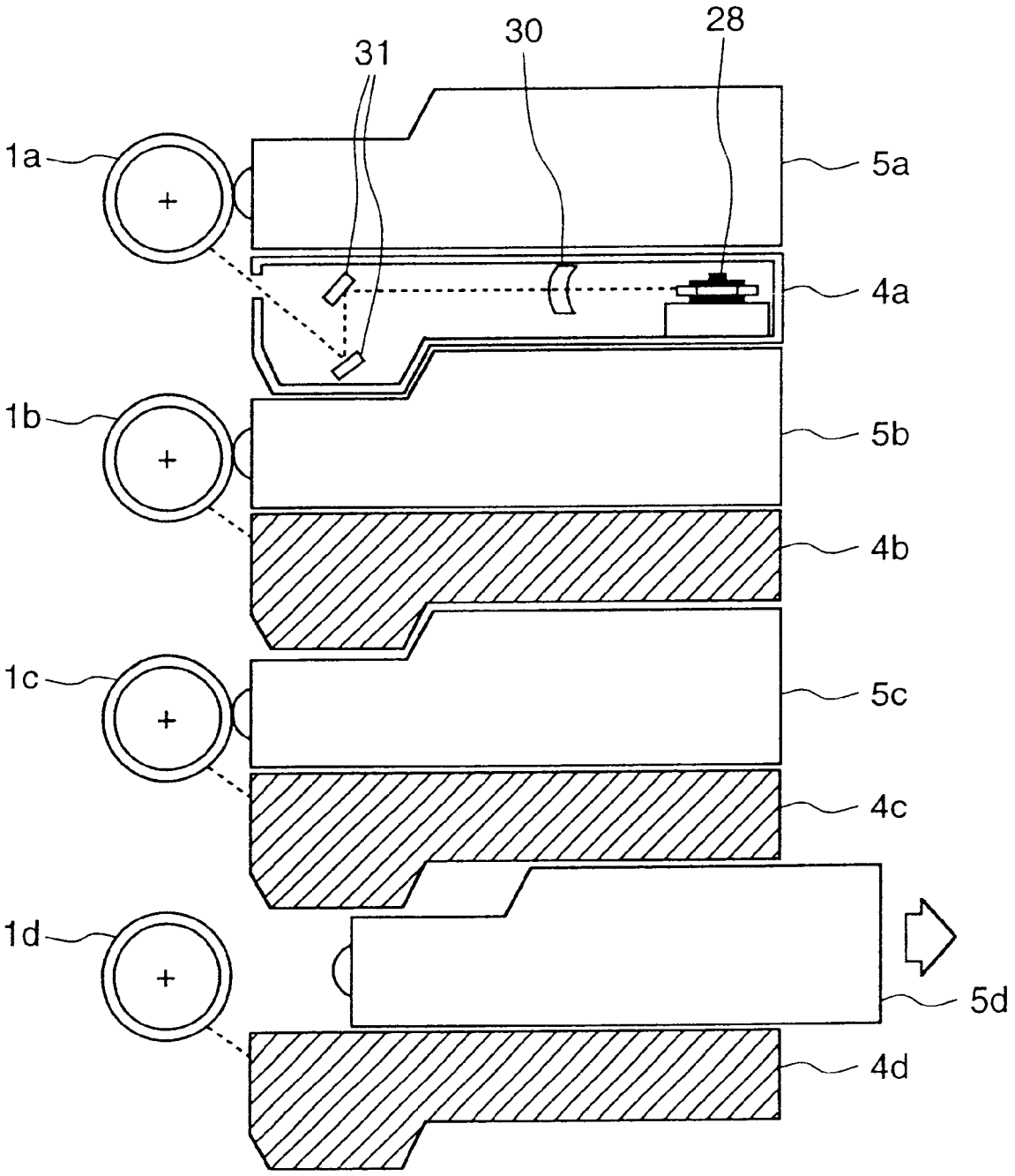
FIG. 7 is a side view of another embodiment of the exposure device of the image forming system according to the present invention.

When the number of polygon mirrors 28 is increased in order to increase the printing speed or the printing width is increased to be compatible with a greater paper size, it is essential to increase the length of the optical path, as discussed above. In this case, the folding mirror 31 inside the laser exposure device must be laid out so that the length of the optical path can be increased. FIG. 7 shows an example of the laser exposure devices in which their lower portions are made convex and part of the folding mirror 31 is laid out in order to increase the length of the optical path. Since the lower portions of the exposure devices 4*a*, 4*b*, 4*c* and 4*d* are made convex, the length of the optical path can be made greater than that of the laser exposure device. The height of the exposure device is greater than that shown in FIG. 6. When the laser exposure device shown in FIG. 7 is used in the image forming system shown in FIG. 6, the convex portions are arranged on photoconductors 1*a*, 1*b*, 1*c*, and 1*d* of exposure devices 4*a*, 4*b*, 4*c* and 4*d*; namely, the folding mirror 31 is laid out on the side of photoconductors 1*a*, 1*b*, 1*c*, and 1*d* of exposure devices 4*a*, 4*b*, 4*c* and 4*d*.

At the same time, projections and depressions are created on the development devices 5*a*, 5*b*, 5*c* and 5*d* laid out above and below the exposure devices 4*a*, 4*b*, 4*c* and 4*d* in conformity with the convex form of exposure devices 4*a*, 4*b*, 4*c* and 4*d*. This makes it possible to make effective use of the space inside the system. This slightly increases the size of the entire system, but the toner storage volume inside the development devices 5*a*, 5*b*, 5*c* and 5*d* can be increased by changing the outside shape of the development devices 5*a*, 5*b*, 5*c* and 5*d*, namely, by increasing the size of the development device. At the same time, replacement of the development devices 5*a*, 5*b*, 5*c* and 5*d* is easy, as shown in FIG. 5, since the convex portion of the exposure devices 4*a*, 4*b*, 4*c* and 4*d* is installed on the photoconductors 1*a*, 1*b*, 1*c*, and 1*d*.

To reduce the size of the entire system, it is effective to reduce the height of the exposure device. The height of exposure devices 4*a*, 4*b*, 4*c* and 4*d* is determined by the height in the space securing the height of the polygon motor 29 and the size of Fθ lens 30.

Figure 8:
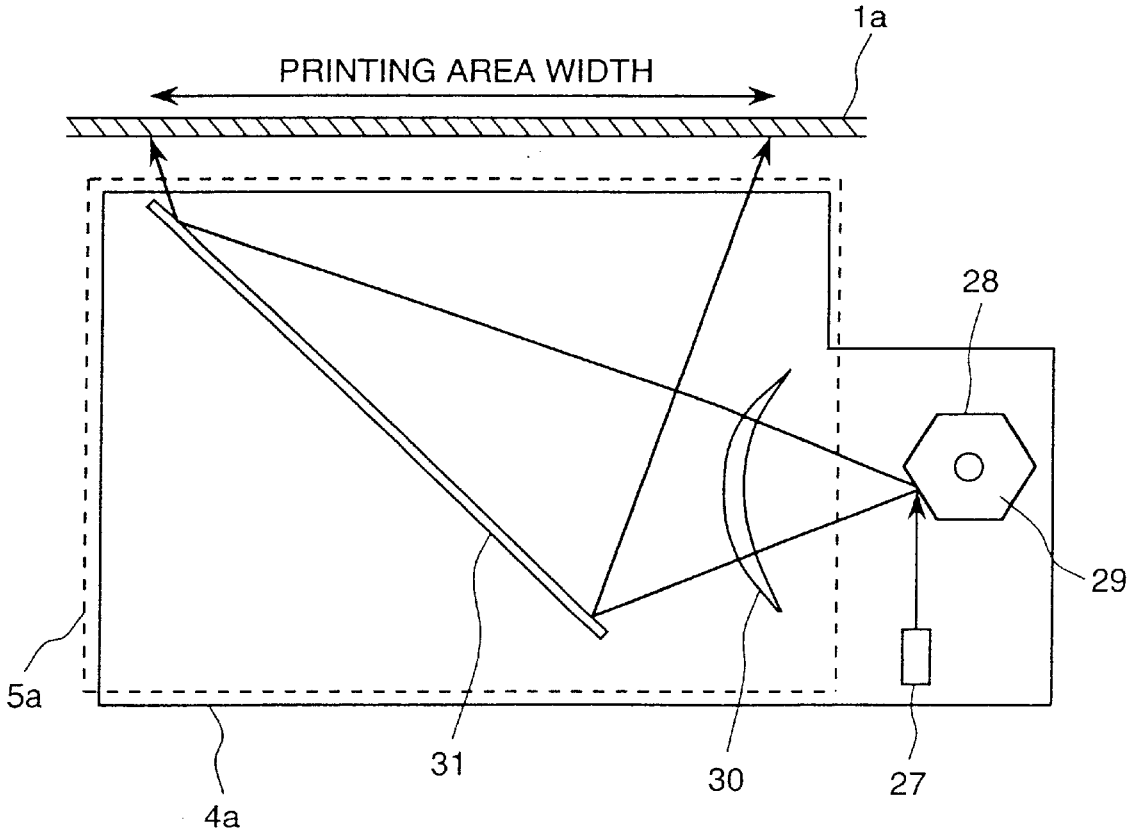
FIG. 8 is a diagram of still another embodiment of the exposure device of the image forming system according to the present invention.

Of these, the polygon motor 29 requires that the mechanism, such as a bearing or the like, be provided in the axial direction in order to ensure a stable rotation. This makes it very difficult to work out a thin configuration. The embodiment of FIG. 8 shows that the polygon mirror 28 and polygon motor 2 9.are installed inside the main unit, namely, the polygon mirror 28 and polygon motor 29 are installed outside the stack of development devices 5*a* (5*b*, 5*c* and 5*d*) indicated by the dotted line. In the stack of development device 5 according this configuration, only the Fe lens 30 and folding mirror 31 to reflect the laser beam are laid out inside the exposure devices 4*a* (4*b*, 4*c* and 4*d*), so the height can be reduced. To work out an optical system like this, the structure of the Fθ lens 30 must be improved, but this is effective in reducing the system size.

A Fθ mirror having Fθ characteristics may be used instead of the Fθ lens 30 and the folding mirror 31.

When images are formed using different multiple laser exposure devices and are superimposed to form a final image, it is essential to minimize the distortion and deformation of the polygon mirror, Fθ lens and folding mirror 31. However, increased accuracy of such optical parts involves very high costs, so errors in distortion and deformation of parts are present in practice, and different distortions occur to the images exposed by the exposure devices. To solve this problem, in the image forming system according to the present embodiment, parts having similar distortion and deformation are combined in advance to constitute four exposure devices, which are built in the main unit. Distortions of the images of exposure devices are made uniform by the combination of such parts, thereby preventing image misregistration. When a combination of such parts is used, it is possible to provide a mechanism to adjust the optical parts position such as a Fθ lens position adjustment mechanism.

The following arrangements can also be used as other embodiments of the exposure devices.

Figure 9B:
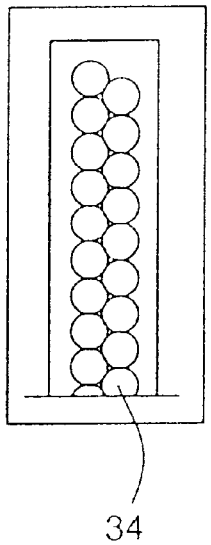
FIGS. 9(*a*) to 9(*c*) are diagram showing an embodiment of the LED light source used as an exposure device of the image forming system according to the present invention.
Figure 9A:
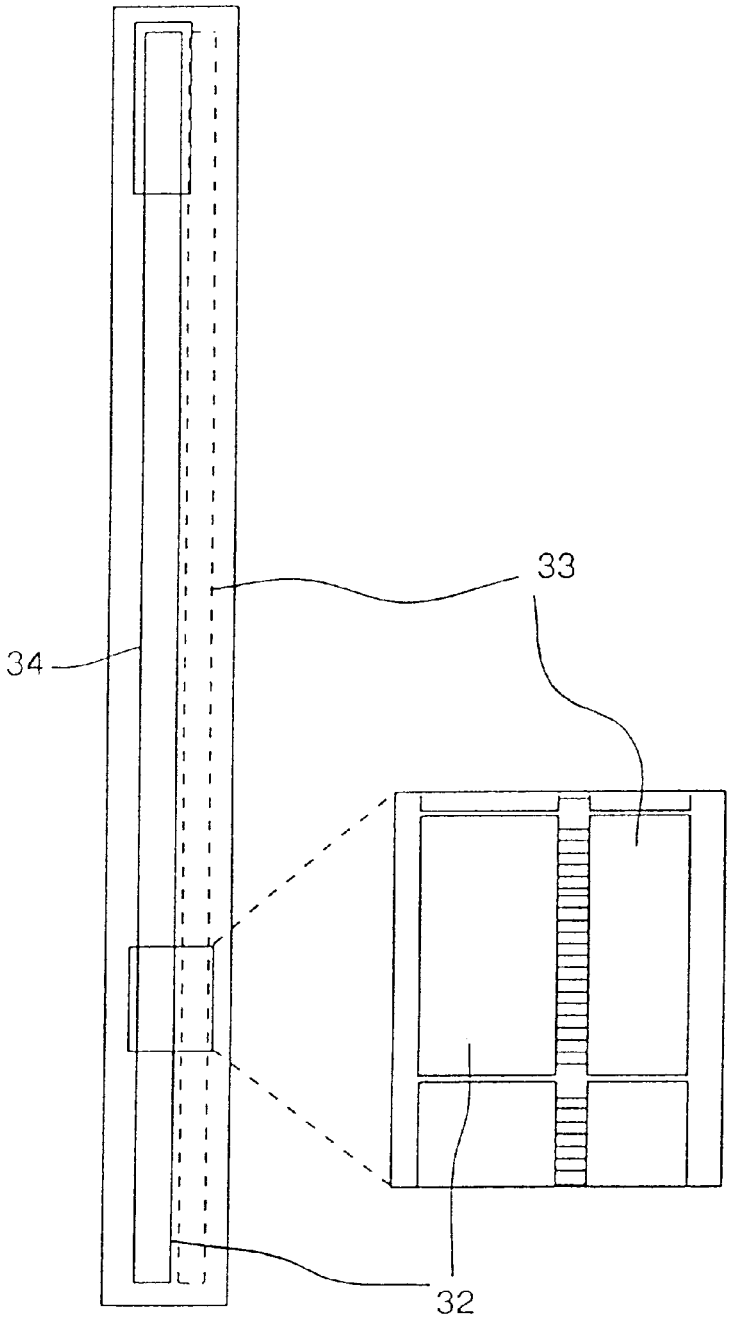
Figure 9C:
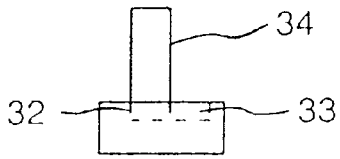

FIGS. 9(*a*) to 9(*c*) show an embodiment where an LED array 32 is applied to the exposure devices 4*a*, 4*b*, 4*c* and 4*d* of the image forming system according to the present embodiment. The exposure devices of the LED array 32 expose the photoconductor using the same number of LEDs as the number of print dots along the image width. It allows exposure devices to be designed with a smaller configuration without requiring a long optical path, as in the case of the laser exposure devices discussed above. The LEDs corresponding to respective dots emit light independently, and this will provide high speed operation easily.

The LED array exposure device comprises a required number of LED arrays 32 arranged in a line, a drive circuit 33 to drive them, and a lens 34 to form on the photoconductor an image of the light emitted from the LED array 32. The number of LEDs for exposure at the printing density of 600 dpi is 600 per inch, namely, 230 to 240 per centimeter. When A4 paper is fed in the longitudinal direction, the required printing width is 21 cm or more. Thus, about 5400 to 6000 LEDs are required. When A4 paper is fed in the lateral direction, the required printing width is 30 cm or more, requiring about 7000 to 9000 LEDs. These LED arrays 32 and driver circuit 33 are created using a semiconductor process.

The LED array exposure device requires a great number of LEDs to be driven independently. Installation of a driver circuit outside the exposure device makes wiring or the like complicated, and is not practical.

To solve this problem, the image forming system according to the present embodiment has an LED array 32 formed on the same chip where the driver circuit 33 is formed to ensure easy interface with the outside. A circuit to correct the variations of the light emitting luminance of each LED and a circuit to enable gradation output can be mounted on this chip in order to make the light emitting luminance of each LED uniform. The LED array 32 and driver circuit 33 are made into chips in units of hundreds to thousands to improve mass production and yield. Scores of chips are combined to secure the desired printing width. If the alignment between LED chips is not accurate in this case, a contrast of images between chips occurs. If alignment is different for each LED array exposure device which exposes each photoconductor, accurate registration of toner images of different colors cannot be ensured.

This requires the alignment among chips not to exceed one dot (42 microns or less at 600 dpi).

In the present embodiment, lens 34 is arranged to ensure that the light emitted by the LED forms an image on the photoconductor.

1. Rod lens eyes are used.

Figure 10:
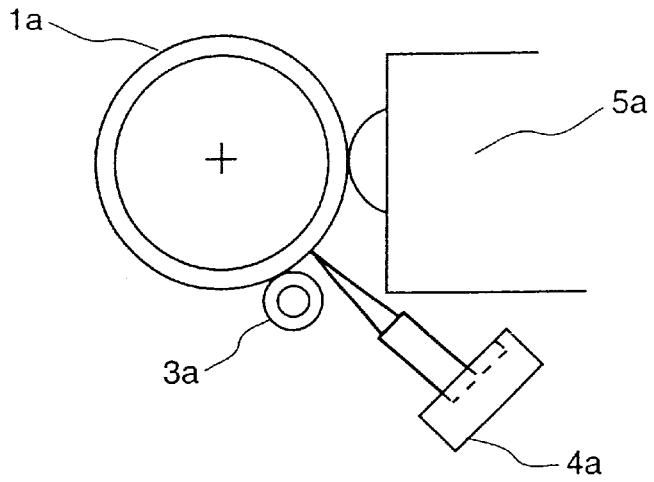
FIG. 10 is a schematic diagram representing the exposure device consisting of a LED light source used in the image forming system according to the present invention.

FIG. 10 shows that LED array exposure device is arranged as an exposure device 4*a* for the photoconductor 1*a*. This arrangement also applies to the other exposure devices and photoconductors.

In the image forming system according to the present embodiment, the units which effect the processes around the photoconductor 1*a* are laid out mainly on the lower portion of the photoconductor 1*a*. Layout allowance of each unit around the photoconductor can be increased by displacing the exposure device 4*a* away from the main unit. To make this possible, it effective to increase the length of the lens of the LED array exposure device, for example, to about 10 to 30 mm in the image forming system shown in FIG. 1, or to elongate the focal distance of the lens, for example, to about 1*b* to 50 mm in the image forming system shown in FIG. 1.

Another embodiment of the exposure devices uses a long-focused lens and a folding mirror 31 installed to expose the photoconductor. In this arrangement, LED array exposure devices are arranged away from the photoconductor 1*a*. This arrangement gives allowance to the process unit layout around the photoconductor.

FIG. 11 is a cross sectional view of the development devices 5*a*, 5*b*, 5*c* and 5*d* used in the present embodiment.

The development devices 5*a* (5*b*, 5*c* and 5*d*) comprise a development unit portion 35 to develop latent images on the surface of photoconductors 1*a* (1*b*, 1*c*, and 1*d*) and a toner storage unit portion 36 to store toner. The performance of the development unit 35 deteriorates with printing, and the toner storage unit 36 has its toner consumed. They must be replaced in conformity with the number of sheets to be printed. In the present embodiment, the development unit 35 and toner storage unit 36 are integrated into one unit to permit simultaneous replacement. This decreases the frequency of replacement of consumables as well as product costs.

The development device 5*a* in the present embodiment has a reduced height due to the horizontal layout of the development unit 35 and toner storage unit 36, thereby contributing to a compact configuration of the entire system.

The development unit 35 of the development device 5*a* in the present embodiment uses a non-magnetic one-component development method. The non-magnetic one-component development method rubs the toner deposited on the development roller 37 using a blade type component 38 and forms a thin layer of toner thereon. At the same time, toner is charged to a specified volume of charge. This is a method of developing the electrostatic latent image on the photoconductor 1*a* by bringing this thin layer of toner directly in contact with the photoconductor 1*a*, without using a carrier.

As described above, images are developed by bringing the thin layer of toner formed on the surface of the development roller 37 directly in contact with the photoconductor 1*a*. Thus, the electrostatic latent images are developed as sharp images, ensuring high picture quality recording. At the same time, such simple parts as development roller 37 and blade 38 are used for toner charging and layer thickness optimization, thereby permitting reduction in the size of the development unit 35 and a reduced price.

The development unit 35 comprises a development roller 37, toner control blade 38, reset roller 39, toner deposit blade 40, raking paddle 41 and toner feed paddle 42.

To ensure firm contact with the drum-formed photoconductor 1*a* by the rigid body, the development roller 37 is covered with an elastic body, such as rubber, around the metallic shaft. At the same time, to permit stable transport of the toner, the surface of the development roller 37 is roughened to an appropriate roughness. A bias voltage is applied to the development roller 37 in order to develop toner on the surface of the development roller 37 on the photoconductor 1*a*. To supply a sufficient amount of toner on the surface of the photoconductor 1*a*, the surface of the development roller 37 is rotated in the same direction as movement of the surface of the photoconductor. In the present embodiment, the development roller 37 rotates in the upward direction at the position opposite to the photoconductor, and the peripheral speed of the development roller 37 is higher than the photoconductor surface speed. The toner control blade 38, which serves to provide electrostatic charging of the toner and to form a specified thin layer of toner on the surface of the development roller 37, is located below the development roller 37. The contract pressure of the toner control blade 38 is important for electrostatic charging and layer pressure control of the toner.

To ensure stability and uniformity, the image forming system according to the present embodiment uses a metallic thin plate. Furthermore, to ensure that the toner does not stop at the position where the toner control blade 38 is brought in contact with the development roller 37 with the rotation of the development roller 37, a counter is used to cause the toner control blade 38 to make contact in the rotary direction of the development roller 37. In this case, to avoid excessive raking of the toner deposited on the surface of the development roller, the flat portion of the toner control blade 38 is brought into contact with the development roller 37, without the tip of the toner control blade 38 being in contact directly with it. The reset roller 39 removes the toner remaining on the surface of the development roller 37 without being developed, and deposits a new layer of toner on the surface. It rotates in the same direction as the development roller 37 to provide both raking and supply of toner at the same time. To ensure contact with the development roller 37 and reliable raking and deposition of the toner, the present embodiment uses a roller having the metallic shaft surface covered with a sponge material. The toner deposit blade 40 is provided to ensure that the toner deposited on the development roller 37 by the reset roller 39 will not fall from the surface of the development roller 37 due to gravity. The raking paddle 41 is provided to ensure that the toner raked off by the toner control blade 38 will not remain close to the blade to solidify and stick there. The raking paddle 41 rotates in the counterclockwise direction, and toner raked off by the toner control blade 38 is discharged toward the toner storage unit 36.

The toner feed paddle 42 is installed to feed toner inside the toner storage unit 36 to the reset roller 39. The reset roller 39 is located at the top of the development device. To feed toner to this portion, it is necessary to feed the toner in the storage unit to the reset roller 39 against the force of gravity. The toner feed paddle 42 rakes the toner of the toner storage chamber up to the area of the reset roller 39 to supply it to the reset roller 39. When the toner feed paddle 42 is used to rake the toner up to the reset roller 39, the rotations of both parts are synchronized so that the toner raking paddle 41 comes in contact with the toner feed paddle 42, thereby facilitating toner rake-up operation.

The toner storage unit 36 comprises toner storage chamber 43 and toner supply paddle 44, as shown in FIG. 11.

The volume of toner determined by the number of sheets to be printed is stored in the toner storage chamber 43. One or more toner supply paddles 44 are arranged in the toner storage chamber 43 to feed toner to the development unit 35 by rotation.

In the development devices 5*a*, 5*b*, 5*c* and 5*d* shown in FIG. 11, the development unit portion 35 and toner storage unit portion 36 are arranged side-by-side in the horizontal direction, as described above, so that the height of the development devices 5*a*, 5*b*, 5*c* and 5*d* is about 40 mm.

The development device 5*a* shown in FIG. 11 has the development unit 35 and toner storage unit 36 integrated into one unit. If the service life of the development unit 35 can be prolonged, they can be arranged as different components, including the development unit 35 and a separate toner storage unit 36 serving as a toner hopper. In this case, only the toner hopper 45 is replaced, with the development device being left in the main unit. The image forming system shown in FIG. 1 allows the toner hopper 45 to be placed closer to the outside of the main unit than the development device 5*a*, thereby ensuring easy replacement.

Figure 12:
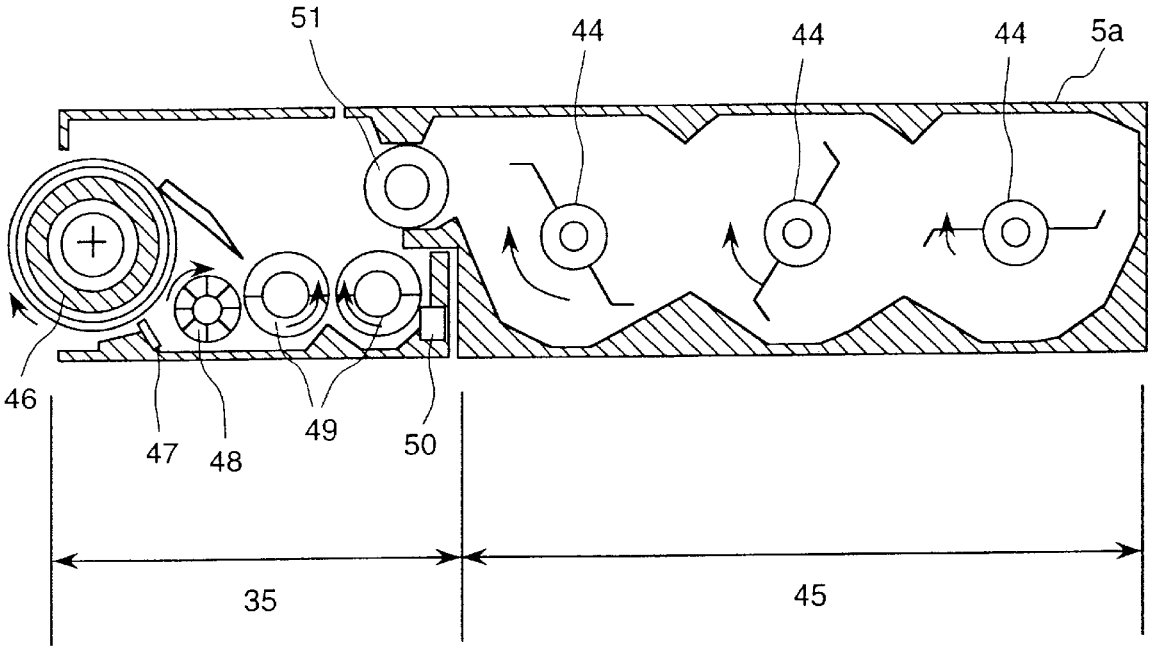
FIG. 12 is a diagram of another embodiment of the development device of the image forming system according to the present invention.

FIG. 12 shows an embodiment of the development device which permits separation of the development unit 35 and toner hopper 45. The development device 5*a* shown in FIG. 12 uses a development method known as a 2-component development method. It is composed of a development unit 35 and a toner hopper 45. To reduce the height of the development device 5*a*, they are arranged in the horizontal direction, as seen in FIG. 12. The 2-component development method provides electrostatic charging of toner by mixing toner and carrier as magnetic particles, and uses a magnetic force to send the developer deposited on the carrier to the photoconductor surface where development is performed.

The development unit 35 shown in FIG. 12 comprises a magnetic roller 46 inside the development unit, developer feed paddle 47, developer feed paddle 48, agitation paddle 49 and concentration sensor 50.

The magnetic roller 46 is designed to apply a magnetic force inside the sleeve, and to feed developer by rotating the sleeve. At the same time, it forms a magnetic brush of developer close to the photoconductor, and develops electrostatic latent image on the photoconductor. The developer feed paddle 47 is provided to supply developer to the magnetic roller 46.

The developer control blade 48 is provided to ensure that an adequate volume of developer will be deposited on the surface of the magnetic roller 46. It restricts excessive developer using a blade formed component. The agitation paddle 49 agitates the toner and carrier in the developer to charge the toner, and stabilizes the image quality by mixing them sufficiently. The toner concentration sensor 50 is provided to measure the volume of the toner contained in the developer unit. Using a magnetic force, it measures the bulk density of the developer, thereby detecting the toner concentration.

The toner hopper 45 consists of a toner storage chamber 43, toner supply paddle 44 and toner supply roller 51. Like the example of FIG. 11, a volume of toner determined by the number of sheets to be printed is stored in the toner storage chamber 43. The toner supply paddle 44 is provided to feed toner to the toner supply roller. The toner supply roller 51 is designed to send toner to the development unit 35.

The development device shown in FIG. 12 uses the developer feed paddle 48 to feed the developer agitated by the agitation paddle 49 to the surface of the magnetic roller 46. The magnetic roller 46 feeds it, and development is performed by the magnetic brush consisting of toner and carrier formed on the surface. The developer is again fed back to the agitation paddle 49 where it is agitated.

When the toner concentration sensor 50 has detected reduction in the concentration of toner in the developer unit, toner is fed from the toner hopper 45 to the development unit 35 and is agitated with carrier by the agitation paddle 49, thereby providing electrostatic charging.

Compared with the non-magnetic one-component development method, the 2-component development method has a disadvantage of having to provide a toner/carrier agitation mechanism and toner concentration sensor, thereby increasing the size of the development device and complicating the structure. Development of toner on the photoconductor is performed by the magnetic brush formed on the surface of the magnet roller by magnetic force. This reduces the contact load between the photoconductor and development device, and the rotary torque of the photoconductor and development device. This feature easily stabilizes the rotation of the photoconductor which is important for registration of images of different colors. The development device shown in FIG. 12 can be used for image registration.

In the image forming system shown in FIG. 1, as described above, the space between photoconductors is 70 to 75 mm when the height of the exposure devices 4*a*, 4*b*, 4*c* and 4*d* is about 30 mm, and the height of the development devices 5*a*, 5*b*, 5*c* and 5*d* is about 40 mm, for example. The height of these units stacked for four colors is about 280 to 300 mm, so the height of the main unit including the height of the form cassette and panel on the top of the main unit is about 500 mm at most. This height is surely acceptable for use in offices.

With reference to FIG. 1, the following description relates to the structure of the intermediate transfer belt 2 used in the image forming system according to the present embodiment.

In accordance with the present embodiment, the intermediate transfer belt 2 is stretched by the belt tension rollers 10*a*, 10*b*, 10*c* and 10*d* which consist of four rollers. Auxiliary transfer rollers 9*a*, 9*b*, 9*c* and 9*d* to bring the photoconductors 1*a*, 1*b*, 1*c*, and 1*d* and intermediate transfer belt 2 in contact with each other are laid out in the space inside the intermediate transfer belt 2.

The belt tension rollers 10*a* and 10*b* are used to stretch the intermediate transfer belt 2 in the longitudinal direction in order to ensure a linear surface along which to install the photoconductors 1*a*, 1*b*, 1*c*, and 1*d* of different colors.

The belt tension roller 10*c* is laid out inside the belt opposite to the surface where the photoconductors of the intermediate transfer belt 2 are laid out. A transfer device 13 is located outside this belt tension roller 10*c*, and serves to transfer the toner image formed on the surface of the intermediate transfer belt 2 to the recording medium. The belt tension roller 10*d* is located above the belt tension roller 10*c*. Unlike the other belt tension rollers 10*a*, 10*b* and 10*c*, it is located outside the intermediate transfer belt 2 so that the intermediate transfer belt 2 is pushed inwardly from the outside.

As described above, the location of the belt tension roller 10*d* ensures sufficient space to install the fusing device 19 and intermediate transfer belt unit cleaner 15 above the transfer device 13. At the same time, the sectional area of the intermediate transfer belt 2 can be reduced to increase the system packaging density.

Furthermore, the belt tension rollers 10*c* and 10*d* are installed at a position where the transfer device 13 and fusing device 19 can be installed to ensure that the paper feed path, important for paper feed, will form a smooth curve. This makes it possible to handle a great variety of paper, ranging from cardboards to envelope and to reduce paper jamming.

Since the intermediate transfer belt 2 is applied in this way, the peripheral length of the belt is about 200 to 350 mm. If the diameter of the belt tension roller is small, the belt shape will conform to and become accustomed to the curvature of the belt tension roller. To avoid this, its diameter is set to about 40 mm. Furthermore, when the photoconductor and belt tension roller are made to have the same diameter, the same cycle can be given to speed variations resulting from eccentricity of the photoconductor and belt tension roller. This ensures easy registration of images of different colors.

In the present embodiment, toner images formed by photoconductors 1*a*, 1*b*, 1*c*, and 1*d* are transferred onto the intermediate transfer belt 2, and are superimposed. This makes it necessary to ensure a stable traveling of the intermediate transfer belt 2, namely, to minimize the variations in belt speed and the offset of the belt. Especially, the belt offset may damage the belt. Minimizing the offset is important also in ensuring system reliability. It is necessary to use the belt tension rollers 10*a*, 10*b*, 10*c* and lad to ensure that the belt is not offset.

In the image forming system according to the present embodiment, the belt tension roller 10*b* located on the downstream side of the photoconductor 1*d* is used as a drive shaft, and drive is applied to maintain the surface of the belt in contact with photoconductors 1*a*, 1*b*, 1*c*, and 1*d* at all times. This reduces the possibility of slack occurring in the surface of the belt in contact with photoconductors 1*a*, 1*b*, 1*c*, and 1*d*, thereby ensuring easy registration of the images of different colors. Furthermore, to allow effective transfer, tension is given to the belt, using as an elastic support the drive shaft and the belt tension roller 10*d* where the process parts such as photoconductors 1*a*, 1*b*, 1*c*, and 1*d*, and transfer device 13 are not installed in the opposite position.

Reduction of the offset of the intermediate transfer belt 2 is important to ensure system reliability and high picture quality. Belt offset is produced when the belt receives the force at a right angle to the rotary direction due to a variation of the parallelism of the components in contact with the intermediate transfer belt 2. Parallel arrangement of these components is difficult at the current machining technological level, so belt offset is unavoidable. To prevent excessive offset of the belt in the image forming system according to the present embodiment, a rib is installed along the belt edge, and a tapered belt offset preventive cap is installed at the end of the belt tension roller 10*a* located inside the intermediate transfer belt 2. When the belt starts to be offset in response to the force at a right angle to the rotary direction, the belt and rib contact the tapered portion of the belt offset preventive cap from the belt at the end of the belt tension roller, thereby preventing the offset. The rib uses resin and rubber materials which have a sufficient thickness and strength to avoid belt offset.

Similarly, another way to reduce belt offset is to install an inverted tapered belt offset preventive component outside the belt tension roller 10*a*. In this configuration, the belt end will run onto the belt offset preventive component to control the belt offset if offset occurs to the intermediate transfer belt 2.

Figure 13A:
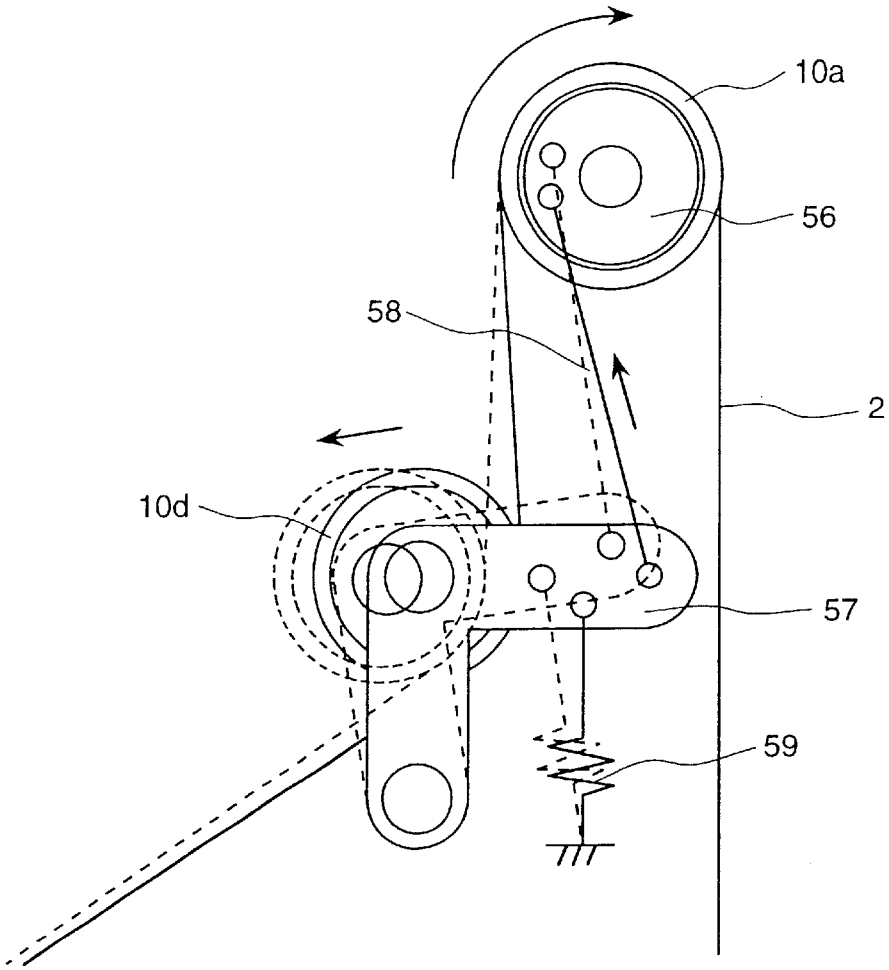
FIGS. 13A, 13B are side view and a front view, respectively, of an embodiment of the belt offset correction mechanism of the image forming system according to the present invention.
Figure 13B:
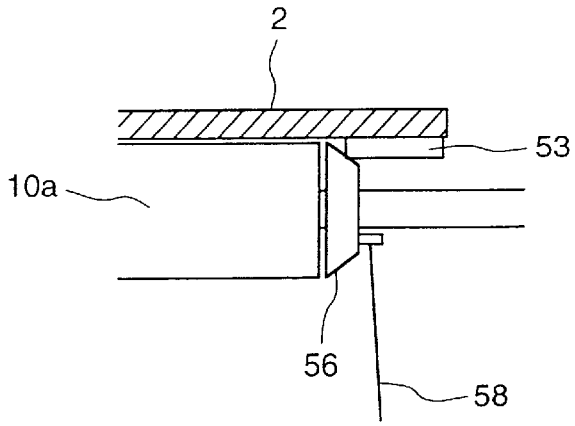

A belt offset correction mechanism can be provided to reduce excessive belt offset. FIG. 13A is a side view and FIG. 13B is a front view of the belt offset correction mechanism which serves to reduce the force of the offset belt and to give the belt a force to move in the opposite direction when the belt is offset. This arrangement consists of a rotatable tapered piece 56 at the end of the belt tension roller 10*a*. The rotary force received by this tapered piece 56 is transmitted to the belt tension roller 10*d* to reduce the tension. When the belt is offset and the rib 53 of the belt comes in contact with the tapered piece 56, the tapered piece 56 receives a rotational force due to friction with the rib 53. When the tapered piece 56 receives the rotational force, belt stretching roller support component 57 is pulled by the rotation transmission shaft 58, as shown in the drawing, thereby reducing the tension of the belt tension spring 59 located on the side where the belt is offset. Then, axial imbalance will occur to the belt tension, and the belt is subjected to a force so as to be offset in the reverse direction, thereby returning the belt to the correct position.

If a material capable of free extension and contraction, such as a rubber material, is selected as the major material for the intermediate transfer belt 2, accurate registration of the images of different colors cannot be made. To avoid this, the belt material must have an elasticity required to provide the belt with minimum extension and contraction. To meet this requirement, a plastic or metallic belt material is used. It is also possible to combine these materials to form a belt. For example, plastics laminated with metal, or rubber laminated with plastics can be used. The present embodiment uses a polycarbonate resin belt having a thickness of 0.1 to 0.2 mm.

The applicable cross-sectional structure of the intermediate transfer belt 2 includes (1) a single layer structure consisting of only the belt base material, (2) a structure of belt base material and belt surface layer, (3) a structure of belt base material and belt back layer, and (4) multiple structures of the belt base material, belt surface layer and belt back layer. The intermediate transfer belt 2 according to the present embodiment uses a single structure where the above-mentioned resin material is a belt base material. However, a belt surface layer made of a thin layer of fluorine resin may be provided in order to optimize the deposition of the toner on the surface, to avoid surface wear and to prevent the belt from being deteriorated by ozone and heat. To increase the belt strength, use of a belt back layer made of a thin metallic material is also possible. Furthermore, toner transfer largely depends on the surface properties of the intermediate transfer belt 2. When the toner release property on the surface of the intermediate transfer belt 2 is poor, toner will deposit on the intermediate transfer belt 2 mechanically and chemically, image defects, such as poor transfer efficiency and dropout of a character thin line will occur. The surface of the intermediate transfer belt 2 is required to have a property which will not to allow easy deposition of toner. To achieve this property, a coated layer such as fluorine resin can be provided on the belt surface. Fine powder such as silica or low-molecular material such as wax can be deposited on the surface of the intermediate transfer belt 2 as a mold releasing agent.

One of the general production methods for belt components is to connect the film materials to form a belt. The belt material created according to this production method necessarily contains seams. The seam of the intermediate transfer belt 2 causes contact loads to occur due to the level difference at the portions of photoconductors 1, transfer device 13 and intermediate transfer belt unit cleaner 15 in contact with the intermediate transfer belt 2. This may result in belt speed variation. It is necessary to make sure that a seam does not occur in the print area. To meet these requirements, the image forming system according to the present embodiment uses a seamless belt material as an intermediate transfer belt. For a seamed belt, the level differences of the seamed portion can be crushed by heat or pressure or reduced by grinding. At the same time, a mechanism can be provided to detect the seam position to ensure that the image formed by photoconductors 1 is not transferred onto the seamed portion.

The electric characteristics of the intermediate transfer belt 2 will be described.

Since toner is made of charged particles, electrostatic force is used to transfer toner from the photoconductors 1*a*, 1*b*, 1*c*, and 1*d* to the intermediate transfer belt 2, and to transfer toner from the intermediate transfer belt 2 to the recording medium. To transfer toner, a homopolar or an antipolar electrical charge is given to photoconductors 1*a*, 1*b*, 1*c*, and 1*d*, intermediate transfer belt 2 and the transfer device 13. Toner is transferred by the electric field generated by this charge. Thus, the intermediate transfer belt 2 is required to have an electrical characteristic to permit effective and stable generation of such a transfer electric field.

An electrical characteristic of the intermediate transfer belt 2 according to the present embodiment is semiconductivity. At the time of transfer, an electrical charge is applied to the intermediate transfer belt 2. If the intermediate transfer belt 2 has a high resistance, the electrical charge applied by each transfer unit remains on the intermediate transfer belt 2, resulting in an unstable transfer, uneven discharge or defective images.

At the point of contact between photoconductors 1*a*, 1*b*, 1*c*, and 1*d*, and intermediate transfer belt 2, toner is transferred from photoconductors 1 to intermediate transfer belt 2 by applying a bias voltage to the auxiliary transfer rollers 9*a*, 9*b*, 9*c* and 9*d* on the back of the intermediate transfer belt 2. In this case, an electrical charge is applied to the back of the intermediate transfer belt 2 from auxiliary transfer rollers 9*a*, 9*b*, 9*c* and 9*d*. Since the intermediate transfer belt 2 moves with the on-going process, the applied electrical charge is carried on the belt and is moved. When the intermediate transfer belt 2 starts to depart from photoconductors 1*a*, 1*b*, 1*c*, and 1*d*, there is an abrupt reduction in the space between the photoconductors 1*a*, 1*b*, 1*c*, and 1*d* and intermediate transfer belt 2. The potential on the intermediate transfer belt rises to start discharging, and an uneven electrostatic charge occurs in the toner on the intermediate transfer belt 2. To reduce this, the electrical charge on the intermediate transfer belt 2 must be allowed to leak with the rise of potential; namely, the resistance of the intermediate transfer belt must be reduced. The capacitance in the space ranges from 100 p to 0.1 pF/cm$^2$. To dampen the potential added to this capacitance earlier than the process speed, it is necessary to set the time constant smaller than the process speed, where said time constant is a product between the resistance of the intermediate transfer belt 2 in the surface direction and this capacitance. For the intermediate transfer belt 2 to move 1 cm in 0.1 sec. in the image forming system shown in FIG. 1 where the process speed is 100 mm/s, the resistance must be 1 G to 10 Tn or less to ensure that the time constant does not exceed that value. In the present embodiment, the belt material resistance must be adjusted to ensure that the resistance will be 0.1 GΩ for a width of 1 cm and a length of 1 cm, much smaller than this value.

To stabilize the potential of the intermediate transfer belt 2, a low resistant component can be installed on the rear of the intermediate transfer belt 2. This configuration can be implemented by making the intermediate transfer belt 2 have two layers, a resistance layer and a conductive layer, or by reducing the surface resistance on the back surface of the intermediate transfer belt 2. Then, the back surface of the intermediate transfer belt 2 can be made to have the same potential over the entire circumference of the intermediate transfer belt 2. If the resistance layer has a high resistance in this configuration, the electrical charge applied to the transfer unit remains on the surface of the intermediate transfer belt 2 and accumulates there. Thus, it is necessary to install a semiconductive resistance layer, similar to the case described above. To prevent an electrical charge from remaining on the intermediate transfer belt 2, it is necessary to select the resistance of each transfer unit so that the electrical charge will be dampened during the movement of the intermediate transfer belt 2.

In the image forming system according to the present embodiment, the surface speed of the intermediate transfer belt 2 is 100 mm/s, and the distance between each transfer unit and toner charging device 11 is only several centimeters. So it is sufficient to select a material where the time constant as a product between the resistance of the resistance layer of the intermediate transfer belt 2 and the capacitance is equal to or smaller than the time required to travel through various portions, which is hundreds of ms. This configuration involves a complicated structure for the intermediate transfer belt 2, but provides a stable potential in each portion, and ensures easy transfer control at each portion.

Furthermore, the same potential can be given to the entire intermediate transfer belt 2 over the entire circumference even if the resistance of the intermediate transfer belt 2 is decreased. In this case, there is an increase of current flowing to each transfer unit, and this requires the power supply capacity to be increased. However, stable transfer is ensured.

A high-resistance material can be used for the intermediate transfer belt 2 by providing an electrostatic charge control component to control the electrostatic charge on the surface of the intermediate transfer belt 2. Such an electrostatic charge control component includes a Scorotron charging device or a Corotron charging device where AC or DC power is employed. A specified volume of electrical charge on the surface of the intermediate transfer belt 2 is applied to control the electrostatic charge of the belt.

To allow toner on the photoconductors 1*a*, 1*b*, 1*c*, and 1*d* to be transferred to the intermediate transfer belt 2, it is necessary to apply the electrical charge with a polarity opposite to that of the toner on the side of the intermediate transfer belt 2, or apply the electrical charge with the same polarity as that of the toner to the photoconductors 1*a*, 1*b*, 1*c*, and 1*d*. Furthermore, to ensure reliable transfer, it is important to ensure a close contact between photoconductors 1*a*, 1*b*, 1*c*, and 1*d* and intermediate transfer belt 2. In the image forming system according to the present embodiment, roller-formed auxiliary transfer rollers 9*a*, 9*b*, 9*c* and 9*d* are laid out on the back of the intermediate transfer belt 2, and a bias voltage is applied thereto.

At the same time, the intermediate transfer belt 2 is pressed against the photoconductors 1*a*, 1*b*, 1*c*, and 1*d* to ensure a close contact. The auxiliary transfer rollers 9*a*, 9*b*, 9*c* and 9*d* are rollers with metallic shafts covered with sponge. A force is applied to press the intermediate transfer belt 2 against photoconductors 1*a*, 1*b*, 1*c*, and 1*d* at an appropriate pressure.

Other structures than the above-mentioned configurations can be used to form the transfer unit to transfer toner on the photoconductors 1*a*, 1*b*, 1*c*, and 1*d* onto the intermediate transfer belt 2.

When a corona charging device is installed on the back of the intermediate transfer belt 2, an electrical charge required for transfer is supplied to the back of the intermediate transfer belt 2, and a blade-formed belt pressing component is used to bring the intermediate transfer belt 2 in close contact with the photoconductors 1*a*, 1*b*, 1*c*, and 1*d*.

If an arrangement is provided to push the auxiliary transfer rollers 9*a*, 9*b*, 9*c* and 9*d* toward the photoconductors at the transfer positions of the photoconductors 1*a*, 1*b*, 1*c*, and 1*d*, an electrical charge required for transfer is applied to the back of the belt by these auxiliary transfer rollers 9*a*, 9*b*, 9*c* and 9*d*.

In the present embodiment, photoconductors 1*a*, 1*b*, 1*c*, and 1*d* are always in contact with the intermediate transfer belt 2. When printing monochrome images, photoconductors for printing unwanted colors are also in contact with the intermediate transfer belt 2. When only some of the photoconductors are required for printing, the unused photoconductors are separated from the intermediate transfer belt and are not used for printing. This method can prolong the service life of the photoconductors. To achieve this, a mechanism can be installed to keep the intermediate transfer belt away from the photoconductors.

Figure 14A:
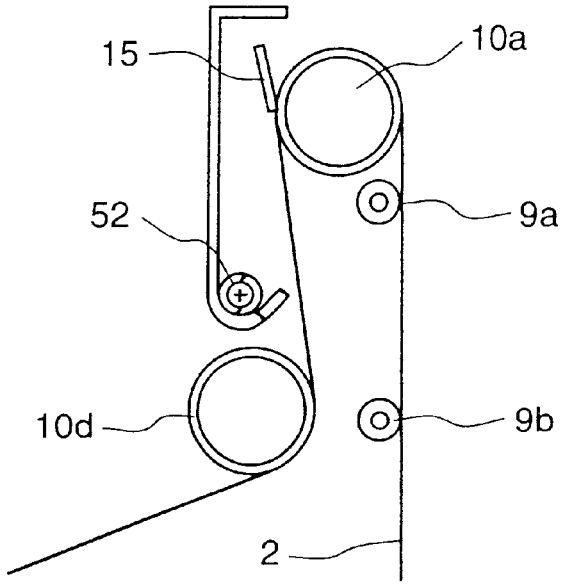
FIGS. 14A, 14B are diagrams of an embodiment of the intermediate transfer belt unit cleaner of the image forming system according to the present invention.
Figure 14B:
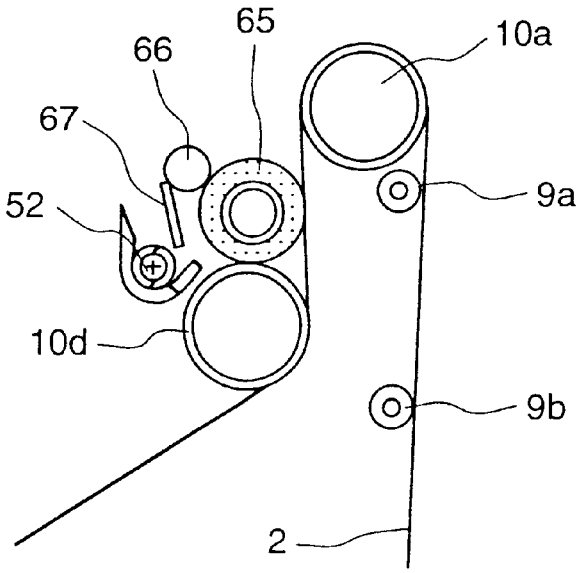

FIGS. 14A and 14B show embodiments of the intermediate transfer belt unit cleaner 15 according to the present invention.

This intermediate transfer belt unit cleaner 15 is designed to clean the toner remaining on the intermediate transfer belt 2. A cleaning blade method is adopted where an elastic blade is used for mechanical raking of toner, similar to the photoconductor cleaner 6. In the image forming system according to the present embodiment, a cleaning blade 15 is installed on the belt tension roller 10*a* at the top of the intermediate transfer belt 2, as shown in FIG. 1, to remove toner on the intermediate transfer belt 2. Furthermore, a similar cleaning blade 15 is also provided on the belt tension roller 10*d* located immediately below the cleaning blade provided on the belt tension roller 10*a* and laid out on the surface of the intermediate transfer belt 2. The belt tension roller 10*d* installed on the surface of the intermediate transfer belt 2 may be directly in contact with toner. Installation of such a cleaning component is preferred. The belt discharged toner collector 52, which serves to recover discharged toner, is located beneath the belt tension roller 10*d*. Toner raked off by the cleaning blade mounted on the belt tension roller 10*a* drops onto the belt tension roller 10*d* and is captured by the cleaning blade to clean the belt tension roller 10*d*.

FIG. 14A shows another embodiment. In this configuration, the belt tension roller lad is equipped with a cleaning blade, and a belt discharged toner collector 52 is positioned in the space formed by belt tension roller 10*d* which keeps the intermediate transfer belt 2 pushed in from the outside. In this configuration, toner raked off by the cleaning blade 15 is shifted to the belt discharged toner collector 52 by gravity. In the image forming system according to the present embodiment, some of the belt tension rollers are installed on the surface of the intermediate transfer belt 2, and are disposed so as to be pushed inward against the belt. This makes it easy to secure a space for the arrangement of the intermediate transfer belt unit cleaner, as described above.

In addition to the above-mentioned method, a brush roller method can be used, where toner is mechanically and electrically removed. by a brush roll supplied with potential. The brush roller method involves a more complicated mechanism than the cleaning blade method, and requires use of a power supply. Since it is not restricted as to the direction of cleaning, however, this method is effective in cleaning from above the intermediate transfer belt 2. At the same time, it is characterized by a smaller contact load with the intermediate transfer belt. This allows for smaller torque to be used for driving. In the configuration shown in FIG. 14B, the brush cleaner 65 is brought in contact with both the intermediate transfer belt 2 and belt tension roller 10*d* to provide simultaneous cleaning of the intermediate transfer belt 2 and the belt tension roller 10*d* in contact with the photoconductor surface. Toner cleaned by brush cleaner 65 is fed to the recovering roller 66 and is raked off by the recovering blade 67. The raked toner falls down into the belt discharged toner collector 52 where it is collected. In addition, a brush roller 65 is laid out in contact with both the intermediate transfer belt 2 and belt tension roller 10*b*, as in the case of FIG. 14B, and the belt tension roller 10*b* is equipped with a cleaning blade. The cleaned toner is shifted to the belt tension roller 10*d*. Such a method can be applied in the image forming system according to the present embodiment.

An uneven electrostatic charge may occur in toner on the intermediate transfer belt 2 due to contact with photoconductors 1*a*, 1*b*, 1*c*, and 1*d*. The uneven charge will take the form of differences in transfer efficiency, and will cause uneven images. In the image forming system according to the present embodiment, a toner charging device 11 is provided to maintain a uniform electrostatic charge of toner on the intermediate transfer belt 2. The toner charging device 11 is equipped with a shield case to enclose a wire. It is a Scorotron charging device with a grid provided between the wire and intermediate transfer belt 2. Electrostatic charge potential on the surface of the intermediate transfer belt 2 is controlled by the grid potential.

To make effective use of the toner charging device 12 in this case, a conductive component set to a specified potential is installed on the back of the intermediate transfer belt opposite to the toner charging device 12.

In the present embodiment, a transfer device 13 is installed to transfer the toner image on the intermediate transfer belt 2 to the recording medium. Toner images on the intermediate transfer belt 2 are color images, so there are different thicknesses of the toner in each part of one image. To ensure complete transfer of these images onto the paper, a close contact between toner and paper is essential. The present embodiment uses a roller-formed transfer device 13 to keep the recording medium in close contact with the toner. At the same time, a bias voltage is applied to ensure toner transfer.

To ensure a close contact of the recording medium with toner, the transfer device 13 uses a roller having the surface of the metallic shaft covered with an elastic layer made of solid or sponge-like rubber material. A voltage required to transfer toner from the intermediate transfer belt 2 to the recording medium is applied to the metallic shaft. To make effective use of the static electricity to transfer the toner, the elastic layer is made of a semiconductive or conductive material. To press the recording medium against the intermediate transfer belt 2 firmly, the transfer device 13 is configured to be pressed against the intermediate transfer belt 2 by adequate gravity.

When the intermediate transfer belt 2 and transfer device 13 are kept in contact with each other as in the present embodiment, fogging toner or the like on the intermediate transfer belt 2 may deposit on transfer device 13 when paper has not passed. Toner deposited on the transfer device 13 will deposit on the back of the recording medium, causing contamination. To avoid this, a mechanism can be installed to keep the transfer device 13 away from the intermediate transfer belt 2. When the paper passes, the transfer device 13 is kept away from the intermediate transfer belt 2 except when the transfer device 13 must be brought in contact with the intermediate transfer belt 2. This minimizes the contamination of the transfer device 13. Contamination of the transfer device 13 due to toner can be removed positively by installing a mechanism to clean the transfer device 13, or a mechanism can be provided which gives an adequate bias voltage having the same polarity as that of toner to the transfer device 13 and transfers toner deposited on the transfer device 13 back to the intermediate transfer unit.

Another configuration of the transfer device in the image forming system according to the present embodiment is provided by a corona transfer device which can also be used if the paper and toner can be brought in contact with each other using a blade-formed paper pressing component.

In the color image forming system according to the present embodiment, an electric charge eliminator for paper 14 (FIG. 1) is installed on the downstream side in the paper feed direction of the transfer device 13.

The recording medium, after toner transfer, retains part of the electrical charge supplied at the time of transfer, so it is adsorbed onto the intermediate transfer belt by static electricity. In the present embodiment, a small-diameter belt tension roller 10*c* is installed at the position opposite to the transfer device 13, and the recording medium can be separated due to the radius of curvature of the belt tension roller 10*c* and the paper rigidity. However, stable separation may not be achieved for thin paper with less rigidity or a highly resistant OHP sheet where the transfer electrical charge is likely to remain. In order to facilitate separation of the recording medium, the image forming system according to the present embodiment has an electric charge eliminator for paper 14 installed to eliminate the remaining electric charge. The electric charge eliminator for paper 14 according to the present embodiment consists of needle-formed minute electrodes with a specified potential that are arranged along the transfer device 13. Electric discharge is caused by the potential on the back of the recording medium and minute electrode, thereby eliminating any electrical charge 61*i* the back of the recording medium and minute electrode.

When more reliable elimination of the electric charge is required to meet higher printing speed requirements, an AC electric charge elimination method using AC corona discharge can also be used as an alternate device for the electric charge eliminator for the paper 14.

When stable paper feed is also required after transfer, a belt transfer device having both the functions of toner transfer and paper separation/feed, instead of the above-mentioned transfer device 13 and electric charge eliminator for paper 14, can also be used in the image forming system in conformity with this method.

A method of roughening the surface of the intermediate transfer belt 2 can also be used to improve the separation of the recording medium. If the surface of the intermediate transfer belt 2 is roughened, space is created between the recording medium and the paper, and adsorption is reduced. This ensures easy separation of the paper. On the other hand, if the intermediate transfer belt 2 is roughened, an image defect such as white dropout is likely to occur. However, when deterioration of picture quality can be prevented by improving the electrostatic charge of the toner, this method can be effectively used.

An embodiment of the fusing device 19 used in the image forming system according to the present invention will be described.

In the image forming system according to the present invention, the fusing device is required to provide performances to ensure good color development of a color image and a high printing speed.

This requires the fusing device to supply the heat required to dissolve the toner at a proper timing. In the compact image forming system as in the present invention, heat generated by the fusing device is likely to affect other processes. Fusing is preferred to be made at the lowest possible temperature.

The present embodiment uses a fusing belt to fuse the toner. Toner fusing section and heating time can be prolonged by arrangement of the fusing belt in a long line along the paper feed path or in much the same direction as the multiple photoconductors 1*a*, 1*b*, 1*c*, and 1*d* are laid out. This makes it possible to sufficiently heat the recording medium where toner is deposited, and ensures fusing of the toner. Since a thin component called a fusing belt is used to perform heat conduction, a quick response is ensured without the need of supplying excessive heat. This makes it possible to fuse the toner at a comparatively low temperature.

Furthermore, as shown in FIG. 1, photoconductor 1*a*, intermediate transfer belt 2 and fusing device 19 are laid out in the horizontal direction, and the intermediate transfer belt 2 is elongated in the longitudinal direction according to the length of the arranged photoconductors 1. The fusing device length in the direction of a paper feed path can be laid out without increasing the size of the system. Thus, there is no problem with use of the fusing device formed by the belt-shaped component as described above.

Figure 15:
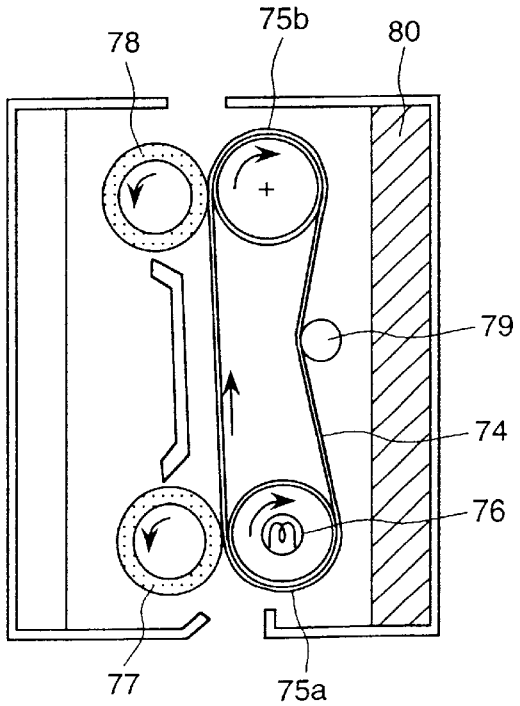
FIG. 15 is a sectional diagram of an embodiment of the fusing device of the image forming system according to the present invention.

FIG. 15 shows the detailed configuration of this fusing device 19.

The fusing device 19 of the present embodiment comprises a belt-formed fusing belt 74, fusing belt tension rollers 75*a* and 75*b* to give tension to the belt, a heater 76, a close contact roller 77 to bring paper in close contact with the fusing belt, a separation roller 78 to separate the paper, and a tension roller 79 to give tension to the fusing belt.

The belt-formed fusing belt 74 can use a heat resistant resin, heat resistant rubber, metallic material or a combination thereof. The present embodiment uses a belt which is producing by coating a nickel belt made of a highly heat conductive metal with a silicone rubber with an excellent mold releasing property having a thickness of 20 to 40 microns. This belt-formed fusing belt 74 is stretched by three rollers. Fusing belt tension rollers 75*a* and 75*b* are metallic rollers, and the close contact roller 77 and separation roller 78 are installed at respective opposite positions. The roller 79 is designed to give tension to the fusing belt, and is fixed by a spring. A heater 76, such as a nichrome wire heater, is installed inside the fusing belt tension rollers 75*a*. The close contact roller 77 is a metallic roller with an elastic layer on the surface. It is laid out to be pressed against fusing belt tension roller 75*a*, and brings the recording medium in contact with the fusing belt 74 to transmit the heat of the fusing belt 74 to the toner. The separation roller 78 installed opposite to the belt tension roller 75*b* separates the recording medium. At the same time, it gives a shearing force to the molten toner and prevents the toner from sticking to the fusing belt 74.

Both the separation roller 78 and the close contact roller 77 are provided as a metallic roller having an elastic layer on the surface.

To ensure that heat generated by the fusing device 19 does not affect the inside the main unit, the fusing device 19 in the present embodiment has a heat insulating component 80 installed inside.

In the fusing device shown in FIG. 15, the distance between the close contact roller 77 and separation roller 78 is 40 to 100 mm when considered from the view point of the layout configuration of the other process parts. So when the process speed is 100 mm/s, the time of 0.4 to 1 sec. to heat the toner on the recording medium can be secured. Since the roller fusing device using two rollers to provide fusing can secure a nip width of only several millimeters at most, toner can be heated sufficiently when the heating time of 0.02 to 0.06 sec. is taken into account.

When easy fusing is possible by use of toner having a low melting point or when fusing performance can be ensured using a method of reducing the fusing rate in conformity with the type of recording medium, it is possible to use a fusing device based on a roller fusing method where toner is fused by passing the recording medium between two rollers heated to a specified temperature.

Figure 16:
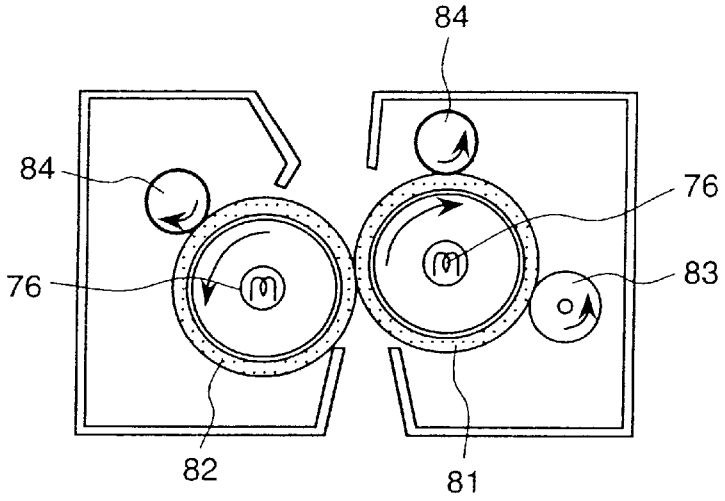
FIG. 16 is a diagram of another embodiment of the fusing device of the image forming system according to the present invention.

FIG. 16 shows the configuration of a roller fusing device representing another embodiment of the fusing device according to the present invention. This configuration uses a pair of rollers having internal heating sources—heat roller 81 and backup roller 82—to fuse toner on the recording medium by heat and pressure. The heat roller 81 and backup roller 82 have their surfaces coated with an elastic body, such as silicone rubber and fluorine rubber. Roller surfaces may be provided with a surface layer of fluorine resin to improve separation from the toner. Furthermore, an oil coating mechanism 83 to paint silicone oil on the surface of the heat roller 81 is provided, thereby improving separation of the toner from the surface of heat roller 81.

Furthermore, a trace quantity of toner and paper powder may adhere to the fusing component at the time of fusing. Such toner and paper may accumulate on the surface, reducing the service life of the roller. To remove a very small quantity of toner and paper, cleaning mechanisms 84 to clean the surface of the roll components are provided on the heat roller 81 and backup roller 82.

It goes without saying that an oil coating mechanism and a cleaning mechanism are applicable to the embodiment shown in FIG. 15.

Figure 17:
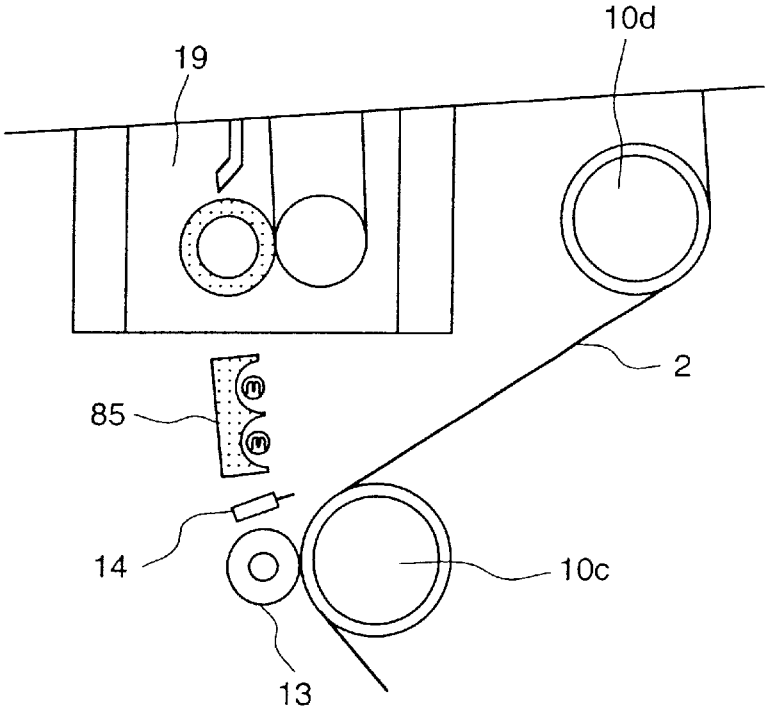
FIG. 17 is a diagram of an embodiment of the paper heating component of the image forming system according to the present invention.

A paper heating component 85 to heat paper can be installed on the upstream side of the fusing device 19 in the paper feed direction as shown in FIG. 17. An infrared ray heater and plate-formed heater may be used as a paper heating component 85 to heat the recording medium in a contact or non-contact mode. Installation of the paper heating component 85 enables the paper to be preheated, thereby ensuring easy fusing.

The following description relates to an embodiment of the form cassette and the peripheral unit according to the present invention. The form cassette 16 according to the present embodiment is intended to store paper. It is laid out on the bottom of the main unit, and accommodates several hundred sheets of paper. To operate the form cassette 16 correctly, it is necessary to install a device which presses the recording medium against the paper feed mechanism from below. In the present embodiment, the form cassette 16 has a built-in spring. It uses a mechanism which pushes the recording medium upward when the form cassette 16 is mounted inside the main unit. To set a great number of recording media into the form cassette 16, it is possible to install a mechanism to more the recording media long in the longitudinal direction by the power of the main unit.

Figure 21:
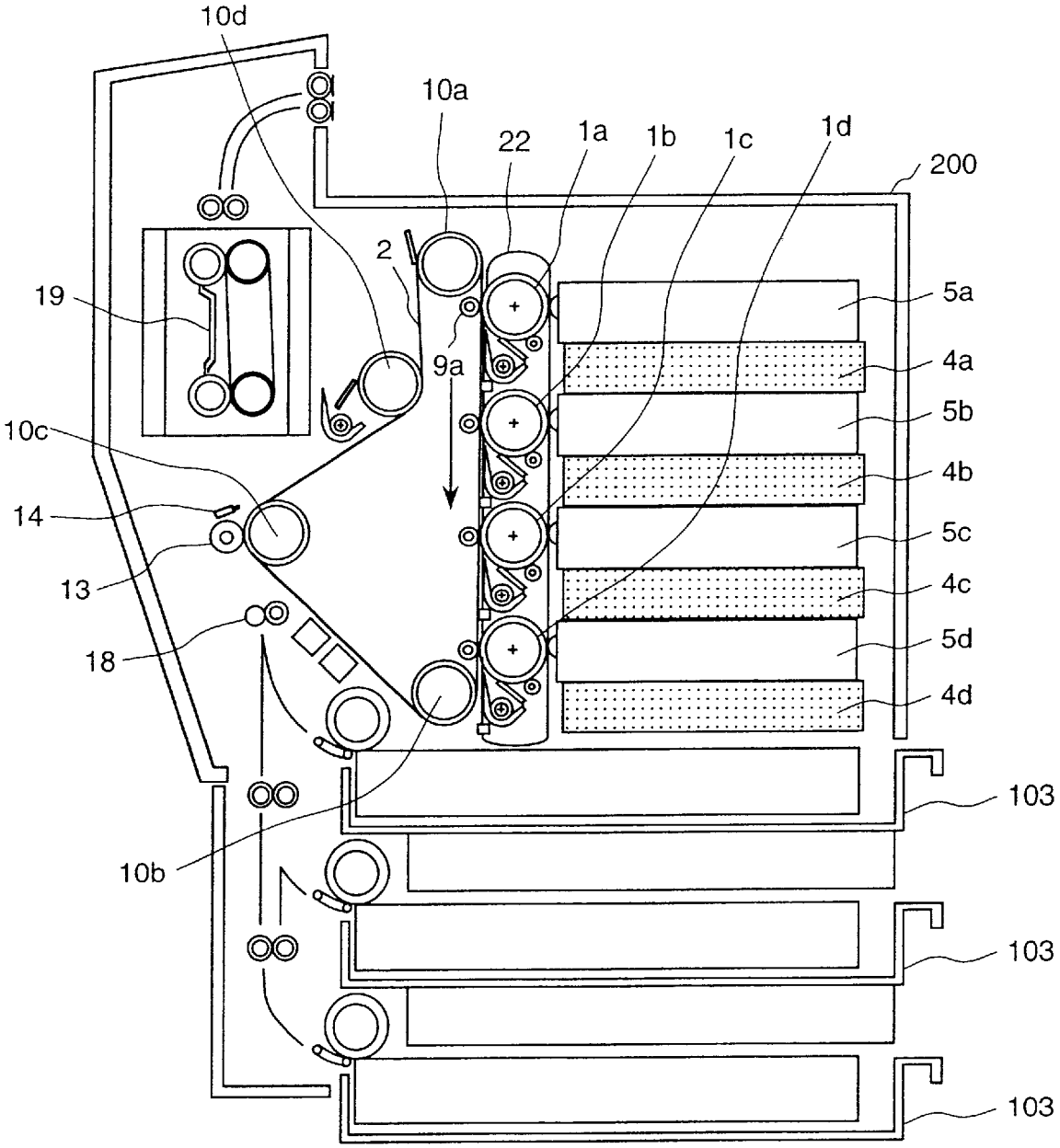
FIG. 21 is a cross-sectional diagram of an embodiment in which a form cassette is added to the image forming system according to the present invention.

When plural form cassettes 16 are provided, the additional cassettes 103 are stacked below the main unit, as shown in FIG. 21. They can be installed without changing the ground contact area. The additional cassettes 103 can accommodate paper of various sizes and types. Such paper can be handled by the above-mentioned embodiments.

The feeding of paper as a recording medium will be described.

The paper feed mechanism 17 operates to feed the recording medium from the form cassette 16 and comprises at least pick roller 86 and separation pad 87. The pick roller 86 has its surface provided with a component, such as rubber and other materials, having a high friction coefficient with the recording medium. It is laid out in contact with the recording medium, and drives the recording medium out of the cassette by rotation.

The separation pad 87 is made of a frictional component, such as rubber and cork, and is laid out in contact with the surface of the pick roller 86. It separates each sheet of the recording media pulled out by the pick roller 86.

The pick roller 86 must be kept in contact with both the tip of the recording medium and the separation pad 87. This makes it difficult to reduce the diameter of the pick roller 86, and this makes it necessary to provide a space to install the pick roller 86 between the form cassette 16 and the imaging process of the main unit. If this space has to be reduced for the construction of the system, the following paper feed mechanism can be used.

An embodiment of the paper feed mechanism according to the present invention will be described.

The recording medium is first divided into a portion to be picked up and a portion to be separated. A pick roller 86, separation pad 87 and retard roller are installed for each. More particularly, the recording medium in the cassette is pulled out of the form cassette 16 by the pick roller 86. In this case, two or more sheets of the recording media may be picked up. To separate two or more recording media in this case, a feed roller and retard roller are installed respectively above and below the recording medium. The feed roller laid out above rotates in the same direction as the pick roller 86, while the retard roller located below is made to rotate in the reverse direction by the torque limiter. When two or more sheets of recording media is sent, the lower retard roller rotates in the reverse direction to push excessive recording medium back to the form cassette 16. If there is only one sheet of recording medium or all excessive ones have been pushed into the cassette side, the torque limiter is actuated by the friction between the recording medium and the upper feed roller to feed the paper to the resist roller 18.

In this method, pick roller 86, the feed roller and the retard rollers are arranged in a line. This allows the space of the paper feed mechanism 17 to be reduced since rollers with smaller diameters can be used.

Another embodiment of paper feed mechanism 17 will be described.

A separation pad 87 is laid out horizontal with the form cassette 16, and the component to pull the recording medium from the form cassette 16 is provided in the form of a pick belt. The pick belt has its surface covered with rubber having a high friction coefficient, or has the surface of the hard rubber belt mate rial covered with rubber with a high friction coefficient to give a strength. The paper feed method is as described above. Since a smaller diameter roller can be used as a pick belt tension roller to stretch the pick belt, the space for the paper feed mechanism 17 can be reduced.

The resist roller 18 according to the present embodiment is provided to adjust the tips of paper and to feed the paper to the transfer unit in conformity with the timing of the toner images on the intermediate transfer belt 2. It uses a combination of two rollers, a metallic roller to increase the rotational speed accuracy and an elastic roller with a metallic shaft covered with rubber or other suitable material to produce a sufficient force to feed the recording medium. The resist roller 18 is also equipped with a paper sensor. When paper has reached the resist roller 18, the pick roller 86 is stopped, the resist roller 18 is driven in conformity with the timing of the image on the intermediate transfer belt 2, thereby adjusting the position of the image and the paper.

Figure 18:
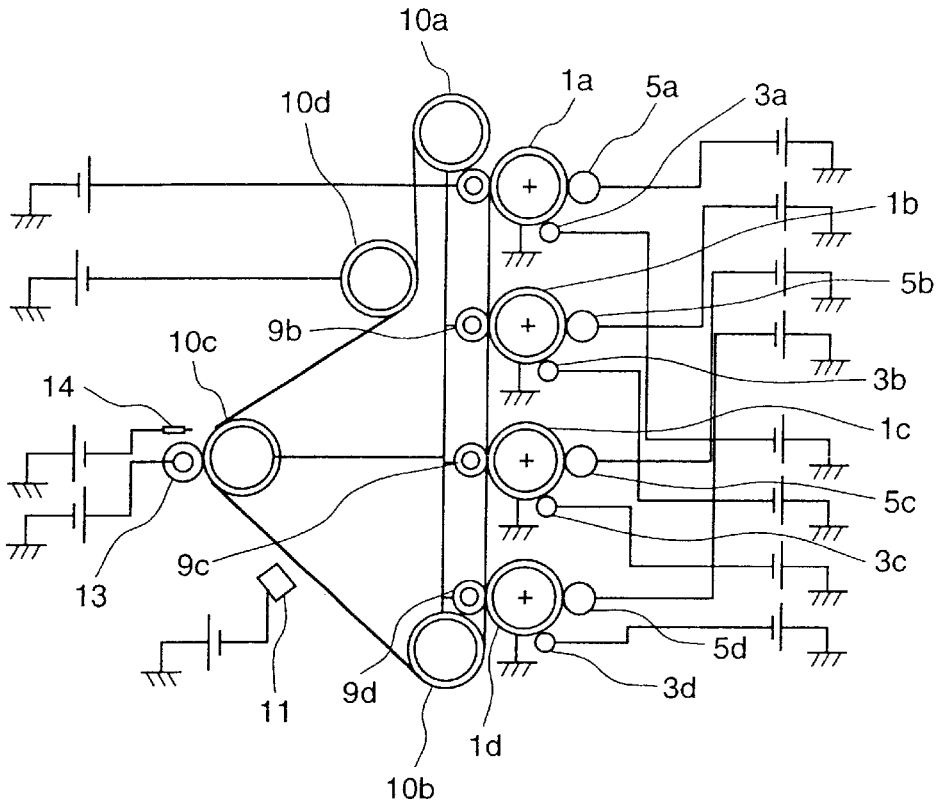
FIG. 18 is a schematic diagram illustrating the bias voltage applied to each process in the image forming system according to the present invention.

With reference to FIG. 18, the bias voltage applied to each of process parts in the image forming system according to the present embodiment will be described.

To develop and transfer toner, a bias voltage must be applied to development devices 5*a*, 5*b*, 5*c* and 5*d* and transfer device 13. The direction of bias during development and transfer is determined by the toner polarity, the development method, and the settings on the zero potential section.

FIG. 18 shows an example of the bias voltage application to illustrate the potential applied to various sections.

The present embodiment uses an organic photoconductor and negative electrostatic toner as the photosensitive materials of the photoconductors, and adopts the reversed development method which allows development at a higher resolution.

Since the charging devices 3*a*, 3*b*, 3*c* and 3*d* charges the photoconductors 1*a*, 1*b*, 1*c*, and 1*d* to a negative potential, a negative bias is applied to the development devices 5*a*, 5*b*, 5*c* and 5*d*. In this case, an a.c. voltage may be superimposed as a bias applied to the charging devices 3*a*, 3*b*, 3*c* and 3*d* in order to stabilize the photoconductor potential, since the charging device is a charging roller. Toner is transferred from the photoconductors 1*a*, 1*b*, 1*c*, and 1*d* to the intermediate transfer belt 2 by making the photoconductor side negative or by making the side of the intermediate transfer belt 2 positive. In the present embodiment, components of different bias voltages, such as charging devices 3*a*, 3*b*, 3*c* and 3*d*, and development devices 5*a*, 5*b*, 5*c* and 5*d*, are arranged around the photoconductors 1*a*, 1*b*, 1*c*, and 1*d*. Thus, a reference potential, namely, zero potential is applied to the photoconductors 1*a*, 1*b*, 1*c*, and 1*d*, and a positive potential is applied to the side of the intermediate transfer belt 2; namely, a positive voltage is applied to the auxiliary transfer rollers 9*a*, 9*b*, 9*c* and 9*d*. When toner is transferred from the intermediate transfer belt 2 to the paper, a positive potential greater than that applied to intermediate transfer belt 2 is given to the transfer device 13.

A negative bias having the same polarity as that of the toner is applied to the belt tension roller 10*d* pushed inside the intermediate transfer belt 2 in order to ensure resistance to adhesion of the toner on the intermediate transfer belt 2. Toner left untransferred on the transfer device 13 may have its polarity reversed, and so a positive bias can be applied to this belt tension roller 10*d*.

Except for the above-mentioned bias configuration, the following configuration is also possible. The belt tension rollers 10*a*, 10*b*, 10*c* and 10*d*. which operate to stretch the intermediate transfer belt 2, and auxiliary transfer rollers 9*a*, 9*b*, 9*c* and 9*d* are set to zero potential; and negative bias is applied to each of the photoconductors 1*a*, 1*b*, 1*c*, and 1*d*, thereby transferring toner to the intermediate transfer belt 2.

A bias voltage applied to these processes can be adjusted by the user to stabilize and improve the image quality. For example, if the exposure level of the exposure device 4*a*, 4*b*, 4*c*, 4*d* and a bias voltage for development can be adjusted by the control panel and switch in response to characteristics of the photoconductors 1*a*, 1*b*, 1*c*, and 1*d*, then the image quality can be adjusted by simple operations.

Control of the bias of each section based on the extension of the above-mentioned method is also effective to stabilize the image quality. For example, when the toner image on the intermediate transfer belt is to be transferred onto the recording medium, the bias voltage may be different depending on the type of recording medium, for example, between a high-resistance OHP and paper with its moisture absorbed. Installation of a transfer voltage control mechanism, as shown in FIG. 19, will ensure transfer stability in response to changes in the type of recording medium and environmental conditions.

Figure 19:
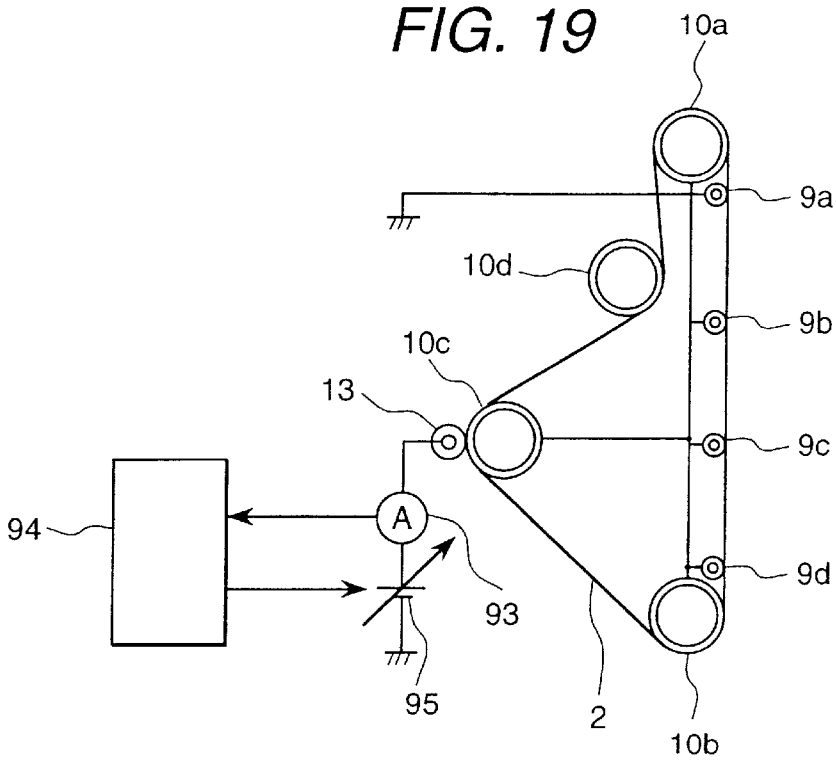
FIG. 19 is a diagram of an embodiment of the transfer voltage controller of the image forming system according to the present invention.

The transfer voltage control mechanism shown in FIG. 19 comprises a transfer device current detector 93 to detect the current flowing to the transfer device 13, a transfer voltage controller 94 to determine the bias voltage of the transfer device 13 based on the result of the transfer device current detector 93, and a high voltage power supply 95 which applies a bias voltage to the transfer device where the output value is variable. It provides a stable transfer in response to the type of recording medium and changes in environmental conditions at all times by detecting the current flowing to the transfer device 13 and by changing the transfer bias voltage in response to this current. Furthermore, it detects the volume of deposited toner, and changes the exposure volume, and bias voltage for development and transfer based on this finding. It also uses the temperature and humidity sensors to detect the environmental conditions in which the system is placed, thereby controlling the bias of each process.

With reference to FIGS. 22 to 25, a configuration equipped with a duplex printing function representing another embodiment of the image forming system according to the present invention will be described.

For duplex printing, the paper must be reversed. The following configuration applies to the image forming system according to the present embodiment.

Figure 22:
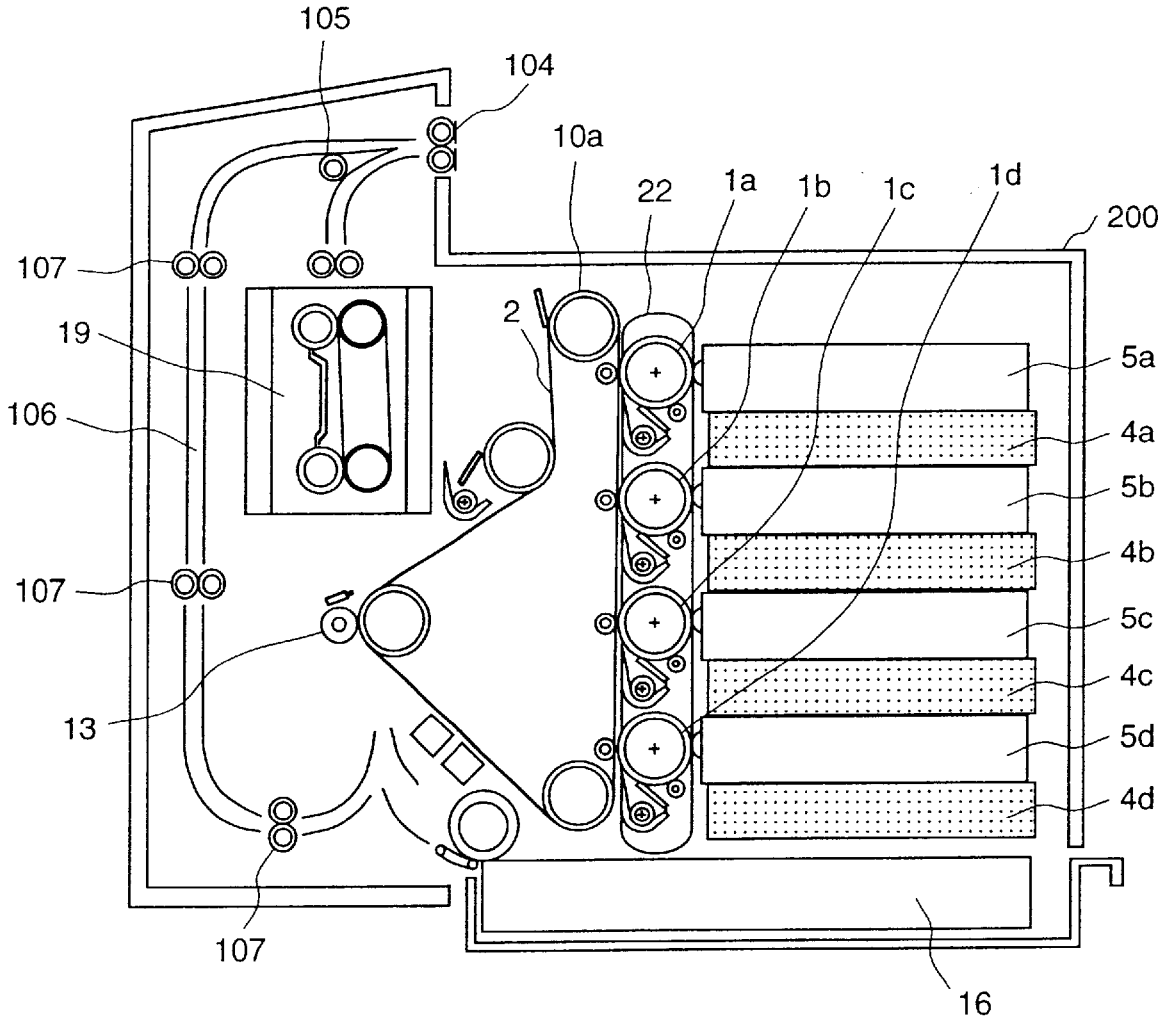
FIG. 22 is a cross-sectional diagram of an embodiment of the duplex printing mechanism of the image forming system according to the present invention.

FIG. 22 shows an embodiment where the paper with a printed surface is reversed by the paper ejector. This duplex printing mechanism has a paper ejector equipped with a feed roller 104 capable of forward/backward rotation and a guide component 105 to guide paper to a duplex paper feed path 106. Furthermore, a duplex paper feed path 106 is provided on the left of the main unit. The paper guide rollers 107 which operate to feed paper on the duplex paper feed path 106 are laid out at intervals smaller than the length of the longest paper to be printed. The outlet of the duplex paper feed path 106 is provided below the resist roller 18 of the main unit. Paper fed through the duplex paper feed path 106 is again fed to the transfer position by the resist roller 18. In this configuration, paper with a printed surface has its tip caught by the feed roller, and is fed to the eject tray of the main unit. The feed roller is reversed when the end of paper has passed through the guide component 105. At the same time, the position of the guide component 105 is changed to feed the end of paper to the duplex paper feed path 106. Then, paper is fed through the duplex paper feed path 106 to the position just before the resist roller 18. Images to be printed on the back of this paper are formed on the intermediate transfer belt 2, and paper is fed into the transfer unit by the resist roller 18 in conformity with timing for transfer. This methods allows the duplex paper feed path 106 to be manufactured in a comparatively compact form. Furthermore, the duplex paper feed mechanism itself does not require a complicated connection with the main unit. This allows users to adjust the settings by themselves.

Figure 23:
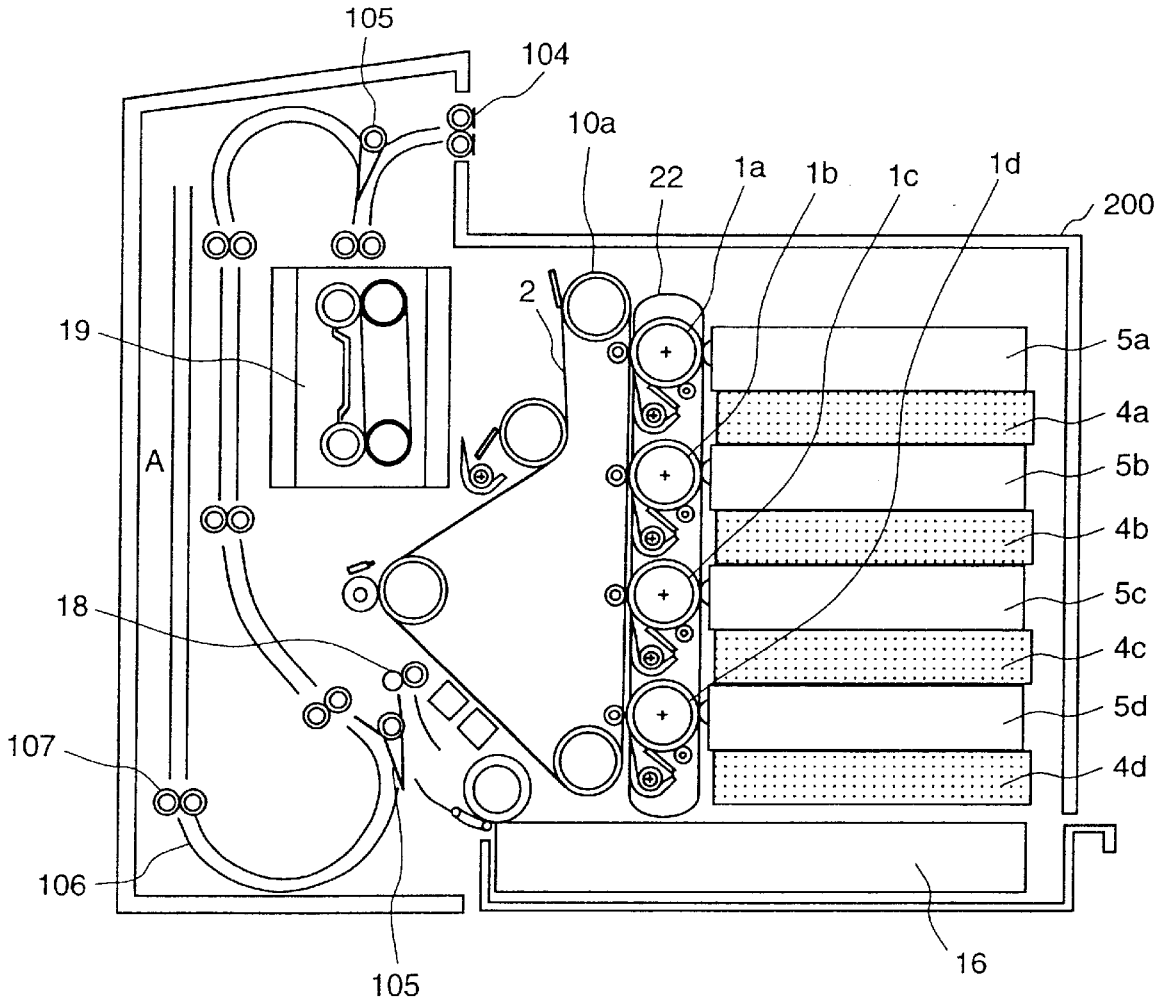
FIG. 23 is a cross-sectional diagram of another embodiment of the duplex printing mechanism of the image forming system according to the present invention.

FIG. 23 shows the method of reversing paper with a printed surface on the left of the system, outside the transfer device 13 and fusing device 19. In this duplex printing mechanism, a guide component 105 to guide paper in a duplex paper feed path 106 is installed on the paper ejector, and an S-formed duplex paper feed path 106 which can reverse the paper is installed on the left of the main unit. The outlet of the duplex paper feed path 106 is provided below the resist roller 18 of the main unit. Paper fed through the duplex paper feed path 106 is again fed to the transfer position by the resist roller 18. According to this configuration, paper with a printed surface is fed to the duplex paper feed path 106 by the guide component 105. The paper is fed through the duplex paper feed path 106 to the position A, and then the paper guide roller 107 is rotated in the reverse direction.

Then, the paper is fed to the position just before the resist roller 18. When images to be printed on the back of this paper are formed on the intermediate transfer belt 2, and are transferred, paper is fed to the transfer unit by the resist roller 18, and images are formed on the back. The paper guide located before the resist roller is provided to prevent the paper fed to position A and fed back from being fed back through the duplex paper feed path 106. The duplex paper feed mechanism itself does not require a complicated connection with the main unit. This allows users to adjust the settings by themselves. Furthermore, duplex printing is possible with paper supplied from the main unit. This method ensures that high quality images will be recorded without the paper being contaminated in the process from paper feed to paper ejection.

Figure 24:
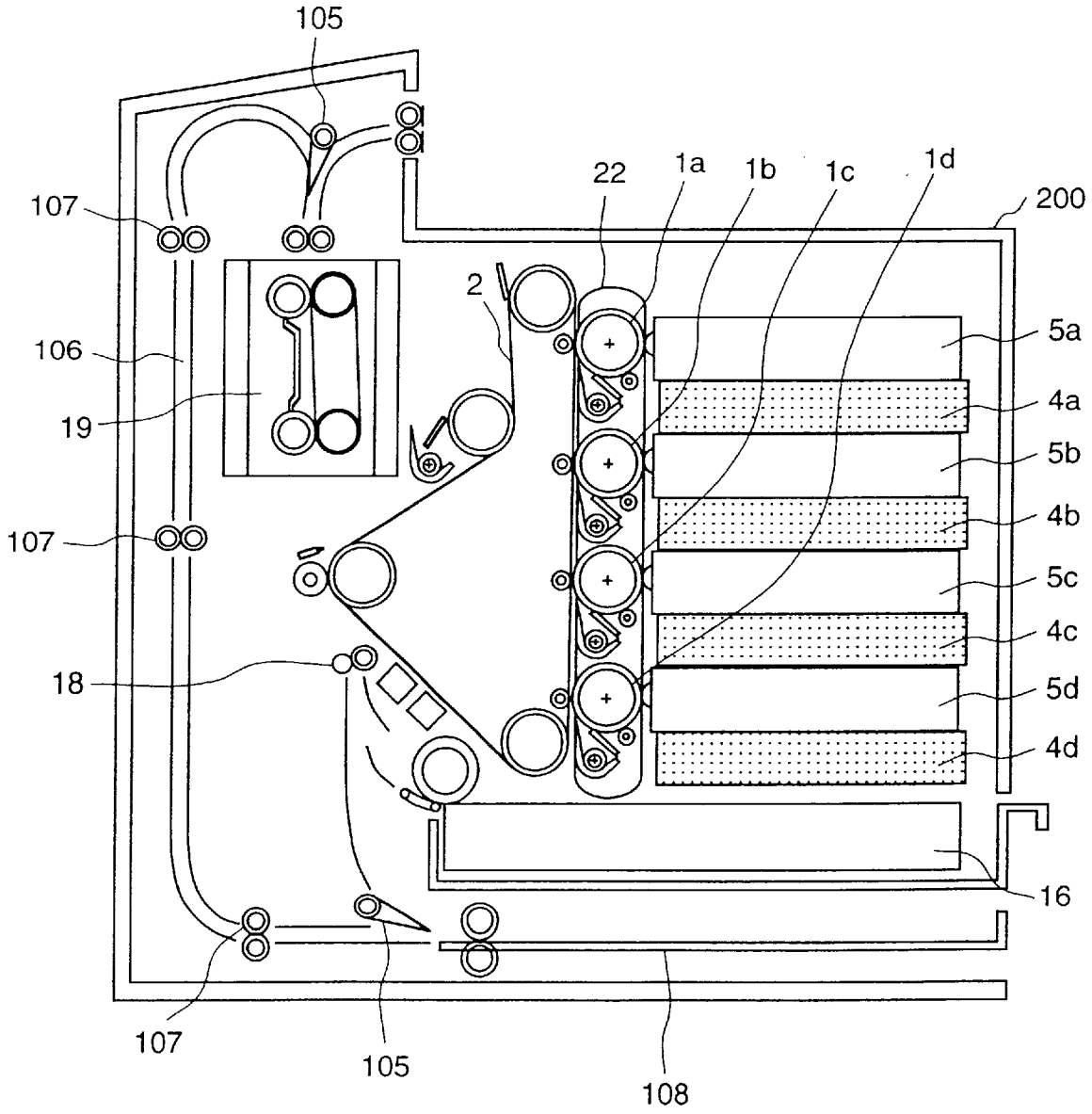
FIG. 24 is a cross-sectional diagram of still another embodiment of the duplex printing mechanism of the image forming system according to the present invention.

FIG. 24 shows how to reverse paper with a printed surface along a path below the system. The ejector of this duplex mechanism has a guide component 105 to guide paper to paper ejector. The duplex paper feed path 106 is laid out on the outer left of the main unit, and the duplex paper storage tray 108 is arranged below the main unit. The outlet of the duplex paper feed path 106 is provided at a duplex paper storage tray 108 located below the main unit. Paper fed through the duplex paper feed path 106 is fed to the duplex paper storage tray 108, where paper is fed in the reverse direction to the resist roller 18. In this configuration, paper with a printed surface is guided to the duplex paper feed path 106 by the guide component 105 and is stored in the duplex paper storage tray 108 through the duplex paper feed path 106. Then, the paper guide roller 107 is rotated in the reverse direction to send the paper to a position just before the resist roller 18. When images to be printed on the back of this paper are formed on the intermediate transfer belt 2, and are ready to be transferred, the paper is fed to the transfer unit by the resist roller 18, and images are formed on the back. The paper guide located at the inlet of the duplex tray is provided to prevent the paper coming from the duplex tray from being fed back to the duplex paper feed path 106. In this method, a duplex paper storage tray 108 is laid out horizontally and can accommodate a great deal of paper for duplex printing. Thus, this arrangement is suited for printing on a great deal of paper. The duplex paper feed path 106 is simple in structure without allowing jamming to occur often, and ensures excellent maintainability.

Along duplex paper feed path is required. Thus, while the paper is being fed, it may shift or incline from the specified position. To make compensation for this, it is possible to provide a regulation component to regulate the paper end or a mechanism to correct the paper position by a positive operation of the regulation component.

To provide a compact configuration, high speed, high picture quality and excellent maintainability, as described above, the image forming system according to the present embodiment has an intermediate transfer belt 2 elongated in the longitudinal direction at the center of the main unit. The same number of photoconductors 1 as that of the required toner colors are arranged in the longitudinal direction on one of these long stretched surfaces. Transfer device 13 and fusing device 19 are arranged on the other surface. A form cassette 16 is laid out below the main unit, and the transfer device 13 and fusing device 19 are arranged from below in that order, thereby feeding, transferring and fusing the recording media. Multiple photoconductors 1*a*, 1*b*, 1*c*, and 1*d* are installed in the photoconductor unit 22, and the exposure device 4*a*, 4*b*, 4*c* and 4*d* is secured to the enclosure 2000 of the main unit so that photoconductor unit 22 can be removed in the direction where photoconductors 1*a*, 1*b*, 1*c*, and 1*d* are arranged, and the development devices 5*a*, 5*b*, 5*c* and 5*d* can be removed in the direction where photoconductors 1*a*, 1*b*, 1*c*, and 1*d* are arranged.

This allows the image forming system according to the present embodiment to provide both high quality image recording and high speed. It also permits the system to provide a compact configuration at a reasonable price and excellent user maintainability.

Another embodiment of the image forming system according to the present invention will be described.

An embodiment of the image forming system including the exposure unit in the photoconductor unit 22 shown in FIG. 1 will be described first with reference to FIG. 25.

Figure 25:
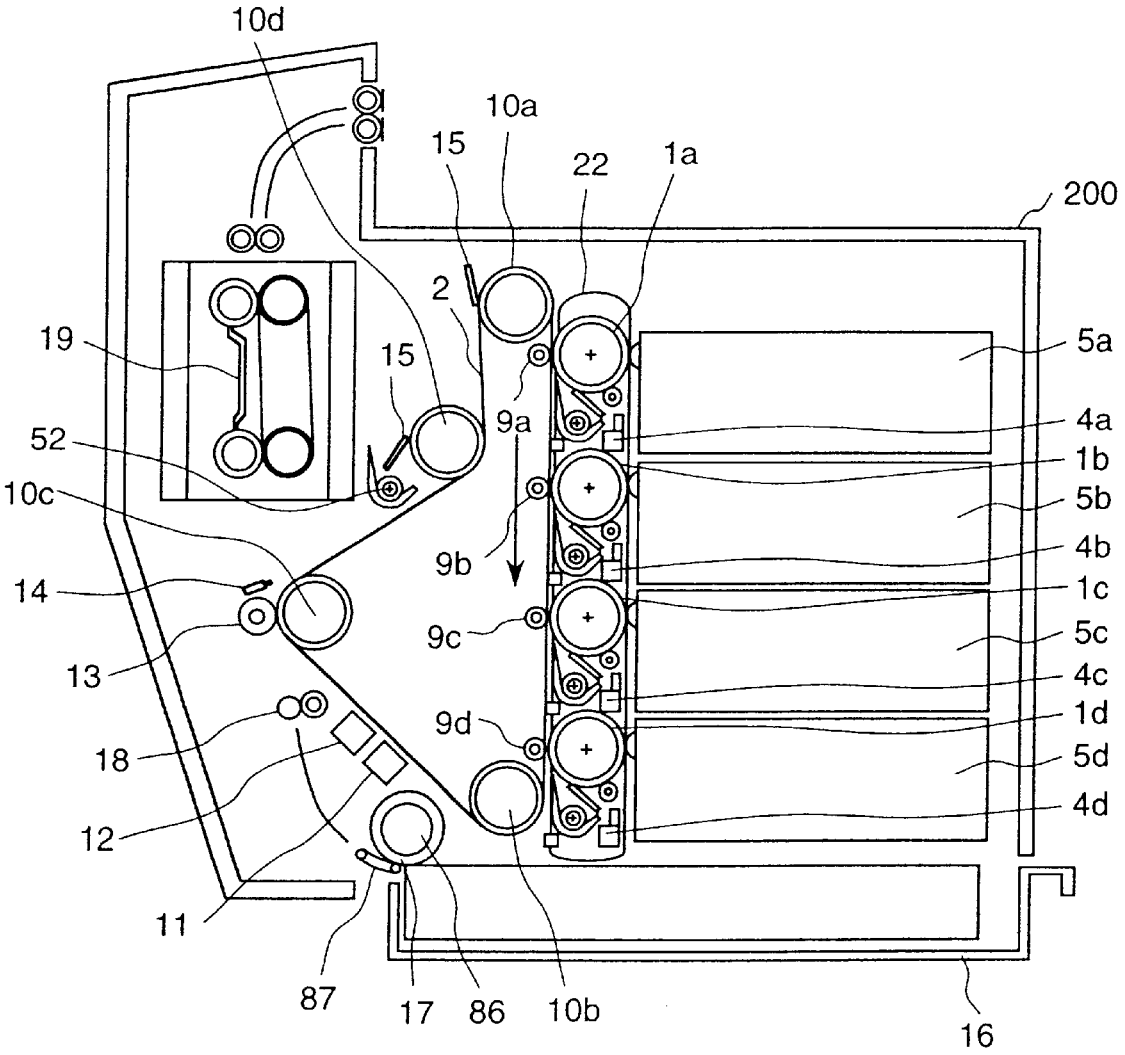
FIG. 25 is a cross-sectional diagram of another embodiment of the image forming system according to the present invention.

In the image forming system shown in FIG. 25, photoconductors 1*a*, 1*b*, 1*c*, and 1*d* of different colors are arranged in the longitudinal direction, and intermediate transfer belt 2 is arranged along one of the surfaces where the photoconductors are laid out. This is the same as the image forming system shown in FIG. 1. The main difference is that, in the image forming system shown in FIG. 1, development devices 5*a*, 5*b*, 5*c* and 5*d* and exposure devices 4*a*, 4*b*, 4*c* and 4*d* are stacked in an alternating arrangement adjacent to the unit 22 in which the photoconductors are arranged. By contrast, in the image forming system shown in FIG. 25, exposure devices 4*a*, 4*b*, 4*c* and 4*d* of different colors are disposed inside the photoconductor unit 22 where the photoconductors 1*a*, 1*b*, 1*c*, and 1*d* of different colors are laid out. In this case, to minimize the size of the photoconductor unit 22, use of a small exposure device is preferred. The embodiment in FIG. 24 uses a LED exposure device, as discussed above. In the present embodiment, exposure devices 4*a*, 4*b*, 4*c* and 4*d* corresponding to different colors and photoconductors 1*a*, 1*b*, 1*c*, and 1*d* are integrated into one unit. The space and parallel is of the photoconductors of different colors and the exposure devices and their positional relationship are laid out accurately and can be maintained under stable conditions. This allows registration of the images of different colors to be performed more accurately. In the embodiment shown in FIG. 1, the capacity of the development devices 5*a*, 5*b*, 5*c* and 5*d* can be increased by an amount corresponding to the space accommodating the exposure devices 4*a*, 4*b*, 4*c* and 4*d*. This ensures a longer service life of the development device.

The peripheral length of the photoconductor cannot be smaller than the size (including length) of the recording medium, and there is a design limit to the length between photoconductors. Thus, the size cannot be reduced in the longitudinal direction literally by the amount corresponding to the space accommodating the exposure devices 4*a*, 4*b*, 4*c* and 4*d*, but the system can be made compact by minimizing the size.

Still another embodiment of the image forming system according to the present invention will be described.

Figure 26:
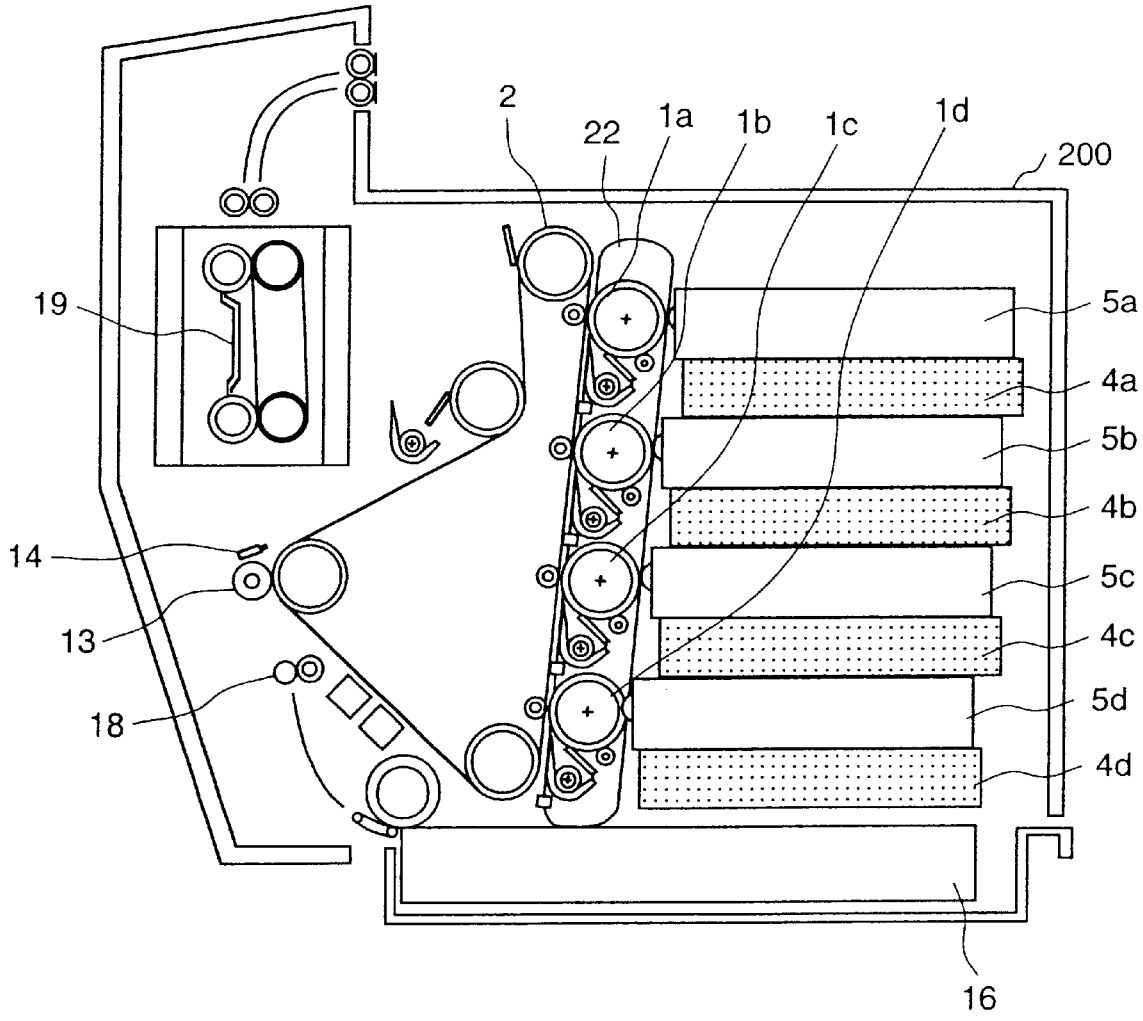
FIG. 26 is a cross-sectional diagram of still another embodiment of the image forming system according to the present invention.

In the embodiment shown in FIG. 1, the charging device 3, exposure device 4, development device 5, intermediate transfer belt 2, photoconductor cleaner 6 and erase lamp 8 are laid out around the photoconductors 1. From the layout sequence and rotational direction of the photoconductors, these process parts must be laid out below the line connecting the development point of the photoconductors and the transfer point. To ensure higher speed and high definition of printing, these process parts must be greater in size and more complicated in structure. To increase the space below the photoconductors in the embodiment shown in FIG. 26, the photoconductor unit 22 with photoconductors 1*a*, 1*b*, 1*c*, and id laid out at a fixed position is arranged obliquely on the side of development devices 5*a*, 5*b*, 5*c* and 5*d*. This photoconductor unit 22 can be replaced when it is pulled out upward in a slanting direction where the photoconductors are laid out. Upward shift of the contact point between the photoconductor and intermediate transfer belt 2 gives allowance to the structure of the process parts laid out below the photoconductors. At the same time, the layout allowance can be increased.

The intermediate transfer belt 2 in an embodiment of the image forming system according to the present invention will be described with regard to a configuration that is elongated in the lateral direction.

Figure 27:
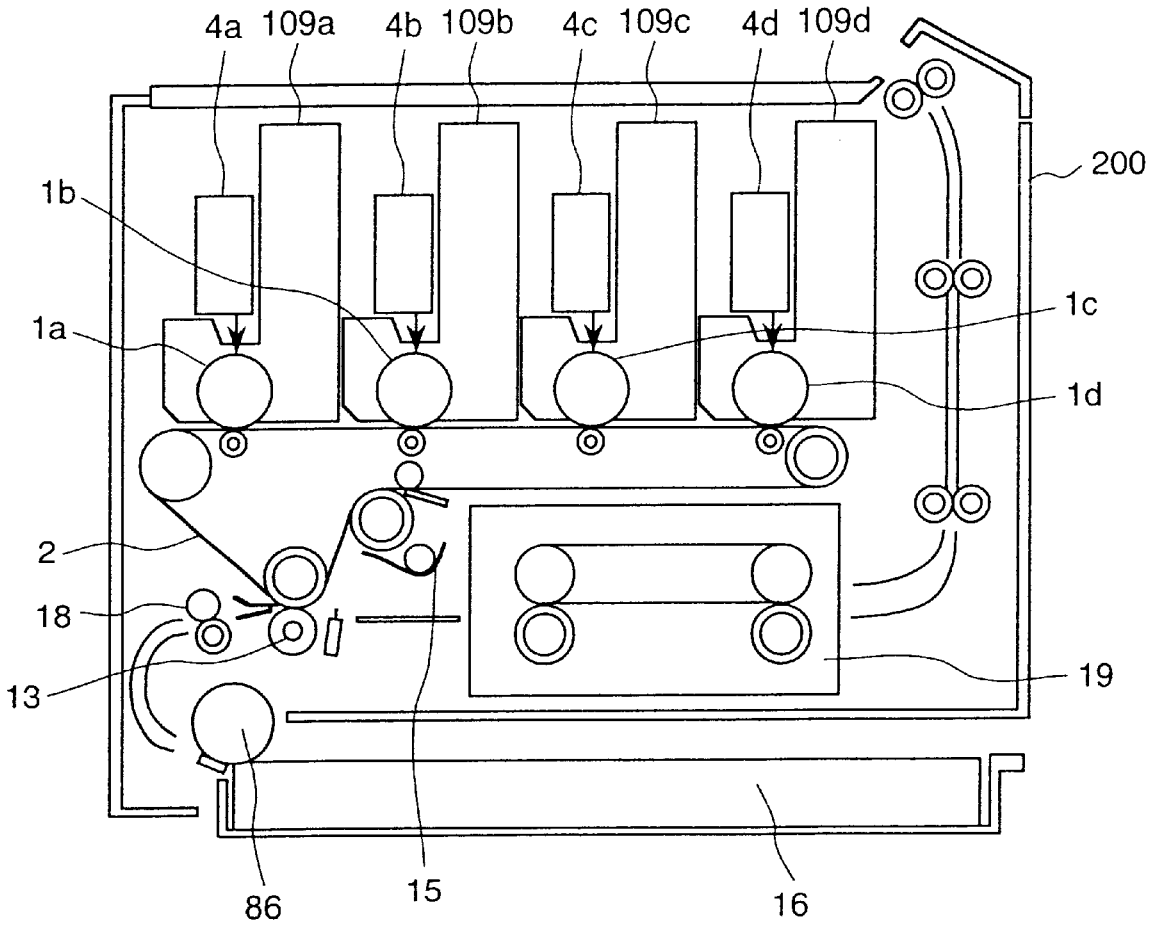
FIG. 27 is a cross-sectional diagram of one embodiment of the image forming system according to the present invention which is provided with an intermediate transfer belt that is elongated in the lateral direction.

In the embodiment shown in FIG. 27, photoconductors of different colors are arranged in the lateral direction. This is different from the arrangement of the embodiment shown in FIG. 1 where photoconductors are arranged in the longitudinal direction. The system configuration is made compact by placing the photoconductors on one side of the intermediate transfer unit and the fusing device on the opposite side.

The intermediate transfer belt 2 stretched along a horizontal line is provided at the center of the main unit. Photoconductors 1*a*, 1*b*, 1*c*, and 1*d* in the same number as that of four tone colors are installed on the upper side of the intermediate transfer belt 2 in the lateral direction, namely, in the direction in which the intermediate transfer belt is stretched. Imaging units 109*a*, 109*b*, 109*c* and 109*d*, to provide electrostatic charge, development and cleaning, and exposure device 4*a*, 4*b*, 4*c* and 4*d* are installed around each photoconductor. Furthermore, transfer device 13 and intermediate transfer belt unit cleaner 15 are laid out around the intermediate transfer belt 2, and a paper feed path to allow paper to pass by is provided below the intermediate transfer belt 2. A form cassette 16, pick roller 86, resist roller 18, transfer device 13, fusing device 19 and paper eject path are installed along the paper feed path.

The present embodiment shown in FIG. 27 has the photoconductors laid out on one side of the intermediate transfer unit, and the fusing device installed on the opposite side. This provides a smaller size than the one where the intermediate transfer unit and fusing device are laid out in parallel. Furthermore, to ensure stable feed of the recording media, the form cassette 16 is placed below the main unit, and the transfer device 13 and fusing device 19 are laid out in that order from below, thereby feeding recording media upward, for transferring and fusing.

Figure 28:
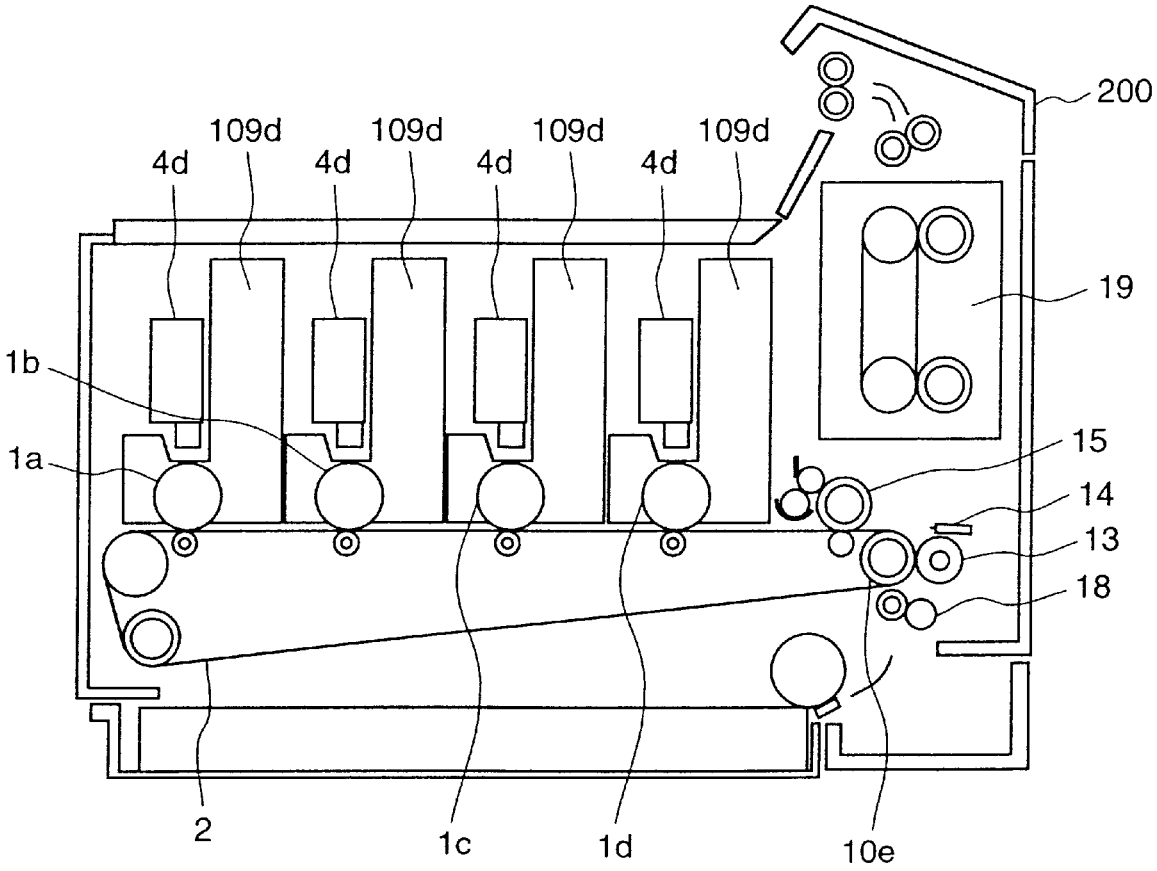
FIG. 28 is a cross-sectional diagram of another embodiment of the image forming system according to the present invention which is provided with an intermediate transfer belt that is elongated in the lateral direction.

In the embodiment shown in FIG. 28, the intermediate transfer belt 2 stretched along a horizontal line is provided at the center of the main unit. Photoconductors 1*a*, 1*b*, 1*c*, and 1*d* in the same number as that of four tone colors and the fusing device 19 are installed in the lateral direction above the intermediate transfer belt 2. Imaging units 109*a*, 109*b*, 109*c* and 109*d* to provide an electrostatic charge, development and cleaning, and exposure devices 4*a*, 4*b*, 4*c* and 4*d* are laid out on and around the photoconductors. The fusing device 19 is placed above the belt tension roller 10*e* located on the surface where photoconductors are laid out on the most upstream side of the intermediate transfer belt 2. The transfer device 13 and intermediate transfer belt unit cleaner 15 are located around the intermediate transfer belt 2. The transfer device 13 is installed opposite to the belt tension roller 10*e* located on the surface where photoconductors are laid out on the most upstream side of the intermediate transfer belt 2. The intermediate transfer belt unit cleaner 15 is laid out on the top surface of the intermediate transfer belt 2. The image forming system according to the present embodiment has a paper feed path which allows paper to be fed from below the intermediate transfer belt 2 to the upper left without bending the paper very much. The paper feed path has a form cassette 16, pick roller 86, resist roller 18, transfer device 13, fusing device 19 and paper eject path installed along the feed path.

The form path as a paper feed path is formed in a large circular arc, and is located close to the outer surface of the system. This allows various recording media, such as cardboard, letter and postal card, to be fed from the form cassette 16 without being jammed. It also facilitates removal of paper after jamming.

The present invention provides an image forming system characterized by a compact configuration, high speed and high quality recording. It also provides an image forming system featuring an excellent maintainability.

What is claimed is:

1. An image forming system comprising:

multiple photoconductors arranged in a line and combined in one body of said image forming system;

multiple development devices and multiple exposure devices arranged on one side of said line of said multiple photoconductors;

an intermediate transfer device arranged on the other side of said line of said multiple photoconductors; and a form cassette arranged below said line of said multiple photoconductors;

wherein said multiple development devices and multiple exposure devices are arranged alternately with respect to the direction of said line of said multiple photoconductors;

said image forming system further comprising a transfer device and a fusing device arranged at an opposite side of said intermediate transfer device with respect to the arrangement of said intermediate transfer device to said line of said multiple photoconductor.

2. An image forming system according to claim 1, comprising an enclosure wherein multiple exposure devices are arranged that are fixed to said enclosure.

3. An image forming system according to claim 1, wherein multiple development devices and multiple exposure devices are arranged alternately in the order of exposure devices and development devices from the side of said form cassette.

4. An image forming system according to claim 1, wherein a paper heating component to heat recording media is provided between said transfer device and said fusing device.

5. An image forming system according to claim 1, in which said line of said multiple photoconductors combined in one body is removable from said image forming system and replaceable therein as one body.

6. An image forming system according to claim 1, wherein said line of said multiple photoconductors extends in a vertical direction of said image forming system and is exchangeable as one body.

7. An image forming system comprising:

multiple photoconductors arranged in a line and combined in one body of said image forming system;

multiple development devices and multiple exposure devices arranged on one side of said line of said multiple photoconductors;

an intermediate transfer device arranged on the other side of said line of said multiple photoconductors; and a form cassette arranged below said line of said multiple photoconductors;

wherein said multiple development devices and multiple exposure devices are arranged alternately with respect to the direction of said line of said multiple photoconductors; and wherein said intermediate transfer device is designed in belt form, at least four rollers are provided to stretch said belt, and at least one of said rollers is arranged in contact with the outer surface of said belt.

8. An image forming system according to claim 7, wherein said roller arranged in contact with the outer surface of said belt is equipped with a cleaner to clean said belt.

9. An image forming system comprising:

multiple photoconductors arranged in a line and combined in one body of said image forming system;

multiple development devices and multiple exposure devices arranged on one side of said line of said multiple photoconductors;

an intermediate transfer device arranged on the other side of said line of said multiple photoconductors; and a form cassette arranged below said line of said multiple photoconductors;

wherein said multiple development devices and multiple exposure devices are arranged alternately with respect to the direction of said line of said multiple photoconductors; and wherein a belted fusing device is arranged on one side of said intermediate transfer device in almost the same direction as that of said line of said multiple photoconductors.

10. An image forming system according to claim 9, wherein said belted fusing device has an insulating material on the side where said intermediate transfer device is installed.

11. An image forming system comprising:

multiple photoconductors arranged in a line and combined in one body of said image forming system;

multiple development devices and multiple exposure pathways arranged at one side of said line of said multiple photoconductors;

an intermediate transfer device arranged at the other side of said line of said multiple photoconductors; and a form cassette arranged below said line of said multiple photoconductors;

wherein said multiple development devices and multiple exposure pathways are arranged alternately with respect to the direction of said line of said multiple photoconductors;

said image forming system further comprising a transfer device and a fusing device arranged in an opposite side of said intermediate transfer device with respect to the arrangement of said intermediate transfer device to said line of said multiple photoconductors.

12. An image forming system according to claim 11, in which said line of said multiple photoconductors combined in one body is removable from said image forming system and replaceable therein as one body.

13. An image forming system according to claim 11, wherein said line of said multiple photoconductors extends in a vertical direction of said image forming system and is exchangeable as one body.

* * * * *